US005971397A

United States Patent [19]

Miguel et al.

[11] Patent Number: 5,971,397

[45] Date of Patent: Oct. 26, 1999

[54] AUTOMATED LEAGUE AND TOURNAMENT SYSTEM FOR ELECTRONIC GAMES

[76] Inventors: Edward Kendal Miguel, 124 E. Sunset Pl., DeKalb, Ill. 60115; Martin Georg Bohn, 1817 Ottawa St., Saginaw, Mich. 48602; Stephen Robert Zastera, 7208 Lakeview Cir., Bloomington, Minn. 55438; Eugene Brooks Lilly, 4209 W. 104th Ter., Overland Park, Kans. 66207

[21] Appl. No.: 08/771,638

[22] Filed: Dec. 20, 1996

Related U.S. Application Data

[63] Continuation of application No. 08/303,604, Sep. 9, 1994, Pat. No. 5,593,349.

[51] Int. Cl.[6] ..... F41J 3/02

[52] U.S. Cl. ..... 273/371; 463/36

[58] Field of Search ..... 273/371, 148 R, 273/408, 409; 364/410, 411; 463/1, 30, 40, 36

[56] References Cited

U.S. PATENT DOCUMENTS

| | | |
|---|---|---|
| 3,665,407 | 5/1972 | Negishi . |
| 3,907,290 | 9/1975 | Fischer et al. . |
| 4,072,930 | 2/1978 | Lucero et al. . |
| 4,131,948 | 12/1978 | Kaenel . |
| 4,232,295 | 11/1980 | McConnell . |
| 4,302,010 | 11/1981 | Kaenel . |
| 4,319,131 | 3/1982 | McGeary et al. . |
| 4,335,809 | 6/1982 | Wain . |
| 4,494,197 | 1/1985 | Troy et al. . |
| 4,572,509 | 2/1986 | Sitrick . |
| 4,575,622 | 3/1986 | Pellegrini . |
| 4,582,324 | 4/1986 | Koza et al. . |
| 4,592,546 | 6/1986 | Fascenda et al. . |
| 4,593,904 | 6/1986 | Graves . |
| 4,636,951 | 1/1987 | Harlick . |
| 4,652,998 | 3/1987 | Koza et al. . |
| 4,722,053 | 1/1988 | Dubno et al. . |
| 4,793,618 | 12/1988 | Tillery et al. . |
| 4,824,121 | 4/1989 | Beall et al. . |
| 4,842,275 | 6/1989 | Tsatskin . |
| 4,872,541 | 10/1989 | Hayashi . |
| 4,910,677 | 3/1990 | Remedio et al. . |
| 5,083,271 | 1/1992 | Thacher et al. . |
| 5,101,354 | 3/1992 | Mowers et al. . |
| 5,114,155 | 5/1992 | Tillery et al. . |
| 5,127,044 | 6/1992 | Bonito et al. . |
| 5,198,976 | 3/1993 | Form et al. . |
| 5,340,119 | 8/1994 | Goldfarb . |
| 5,359,510 | 10/1994 | Sabaliauskas . |
| 5,370,306 | 12/1994 | Schulze et al. . |
| 5,384,561 | 1/1995 | Smith . |

FOREIGN PATENT DOCUMENTS

| | | |
|---|---|---|
| 9409337 | 4/1994 | Norway . |

*Primary Examiner*—Michael O'Neill

[57] ABSTRACT

A league and tournament system is disclosed which includes a centralized league machine that transmits data to one or more of a plurality of electronic dart games via modem or using a wireless portable data storage device. Transmission of information from the electronic dart machines can be via modem, facsimile transmission, or using the portable data storage device. The electronic dart machines are configured to receive and utilize league and tournament database information from the league machine for a variety of purposes, including automatic implementation of player handicaps, automatic control of match play, and team and player registration using the dart machine. The dart machine has a monitor that displays context sensitive menus using information obtained from the league or tournament database. The dart machine includes a barcode card reader that permits identification of league and tournament participants using barcode cards. The dart machine can also respond to other types of barcode cards for such purposes as crediting games and providing access to machine performance data and certain machine servicing functions. Intergame communication within an establishment is provided either by hardwiring the dart machines or using infrared communication.

9 Claims, 33 Drawing Sheets

FIG - 6

SIGN-UP SHEET FOR : Monday Night Cricket League

PLAYERS KEEP THIS SIDE

TEAM CAPTAIN ID #1234567
LEAGUE # 25 - MONDAY CRICKET
TEAM # 49 -
PLAYER # 450 -

CAPTAIN
LEAGUE # 25 - MONDAY CRICKET
ID #1234567
TEAM NAME:
PLAYER NAME:
First: Last:
Address:
City: ST: ZIP:
Phone: ( ) - Please Print

PLAYER ID #1234568
LEAGUE # 25 - MONDAY CRICKET
TEAM # 49 -
PLAYER # 451 -

PLAYER
LEAGUE # 25 - MONDAY CRICKET
ID #1234568
TEAM NAME:
PLAYER NAME:
First: Last:
Address:
City: ST: ZIP:
Phone: ( ) - Please Print

PLAYER ID #1234569
LEAGUE # 25 - MONDAY CRICKET
TEAM # 49 -
PLAYER # 452 -

PLAYER
LEAGUE # 25 - MONDAY CRICKET
ID #1234569
TEAM NAME:
PLAYER NAME:
First: Last:
Address:
City: ST: ZIP:
Phone: ( ) - Please Print

PLAYER ID #1234570
LEAGUE # 25 - MONDAY CRICKET
TEAM # 49 -
PLAYER # 453 -

PLAYER
LEAGUE # 25 - MONDAY CRICKET
ID #1234570
TEAM NAME:
PLAYER NAME:
First: Last:
Address:
City: ST: ZIP:
Phone: ( ) - Please Print

SUBSTITUTE ID #1234571
LEAGUE # 25 - MONDAY CRICKET
TEAM # 49 -
PLAYER # 454 -

SUBSTITUTE
LEAGUE # 25 - MONDAY CRICKET
ID #1234571
TEAM NAME:
PLAYER NAME:
First: Last:
Address:
City: ST: ZIP:
Phone: ( ) - Please Print

PLAYERS RETURN THIS SIDE

34" 138 139

FROM BLOCK 616

DISPLAY POINTS PER DART AVERAGE ENTRY SCREEN
624
626
MENU SWITCH 1 ACTIVATED ?
YES
INCREMENT DIGIT BY 1
628
NO
630
MENU SWITCH 3 ACTIVATED ?
YES
DECREMENT DIGIT BY 1
632
NO
634
MENU SWITCH 2 ACTIVATED ?
YES
BUILD PPD # USING POINTS CHOSEN
636
NO
NO
SELECT SWITCH ACTIVATED ?
640
YES
ENTER THE NUMBER DISPLAYED INTO THE PLAYER SELECTED IN MENU 1
642
TO BLOCK 598

FIG - 29

| "ROSTER" FILE | | | | |
|---|---|---|---|---|
| FIELD NO. | FIELD NAME | MAX. FIELD SIZE | DATA TYPE | DESCRIPTION |
| 1 | ENTITY | 1 | CHARACTER | (S)ECURITY, (I)SSUER, (L)EAGUE, (T)EAM, (P)LAYER, (R)ECORD VERSION |
| 2 | ID | 7 | INTEGER | IDENTIFYING NUMBER |
| 3 | NAME | 30 | CHARACTER | LEAGUE, TEAM OR PLAYER NAME (LAST, FIRST) |
| 4 | NICKNAME | 12 | CHARACTER | NICKNAME |
| 5 | NOGM_VID | 4 | INTEGER | LEAGUE RECORD, NO. OF GAMES PLAYED IN A MATCH IN EACH LEAGUE. PLAYER RECORD. OTHER_ID |
| 6 | HCP_MTHD | 1 | INTEGER | "S"=SCRATCH, "N"=NDA, "A"=ADA |
| 7 . . . 16 | FORMAT1 . . . FORMAT10 | 38 . . . 38 | CHARACTER | AS MANY FIELDS AS NEEDED TO DESCRIBE EACH GAME PLAYED, IN ORDER, COMMA DELIMITED. INCLUDING COMMAS, EACH GAME REQUIRES 10 CHARACTERS FOR UP TO 25 POSSIBLE GAMES. |

FIG - 30

| "TEAM LINK" FILE | | | | |
|---|---|---|---|---|
| FIELD NO. | FIELD NAME | MAX. FIELD SIZE | DATA TYPE | DESCRIPTION |
| 1 | LEAGUE_ID | 2 | INTEGER | ASSIGNED LEAGUE NUMBER |
| 2 | TEAM_ID | 3 | INTEGER | TEAM NUMBER |

FIG - 31

| "PLAYER LINK" FILE | | | | |
|---|---|---|---|---|
| FIELD NO. | FIELD NAME | MAX. FIELD SIZE | DATA TYPE | DESCRIPTION |
| 1 | LEAGUE_ID | 2 | INTEGER | ASSIGNED LEAGUE NUMBER |
| 2 | TEAM_ID | 3 | INTEGER | ASSIGNED TEAM NUMBER |
| 3 | PLAYER_ID | 4 | INTEGER | ASSIGNED PLAYER NUMBER |
| 4 | HANDICAP | 14 | INTEGER | SPOT DARTS/SPOT POINTS |
| 5 | AVERAGE | 20 | NUMERIC | SPREE/ AVG. PTS. PER DART/ AVG. MARKS PER ROUND |

FIG - 32

| "MATCH RESULTS" FILE | | | | |
|---|---|---|---|---|
| FIELD NO. | FIELD NAME | MAX. FIELD SIZE | DATA TYPE | DESCRIPTION |
| 1 | ENTITY | 2 | CHARACTER | (M)ATCH, (P)LAYER, (R)ECORD VERSION, (G)AME ID, (N)EW PLAYER |
| 2 | ID_1 | 3 | INTEGER | MATCH RECORD: ISSUER ID<br>PLAYER RECORD: TEAM ID<br>RECORD RECORD: VERSION ID<br>GAME RECORD: GAME ID |
| 3 | ID_2 | 4 | INTEGER | MATCH RECORD: LEAGUE ID<br>PLAYER RECORD: PLAYER ID |
| 4 | DATE_TIME | 12 | INTEGER | MATCH AND PLAYER RECORDS DATE AND TIME IN THE FOLLOWING FORMAT: MMDDYYYYHHMM, WHERE M=MONTH, D=DATE, Y=YEAR, H=HOUR (MILITARY), M=MINUTES, RESPECTIVELY |
| 5<br>.<br>.<br>.<br>.<br>.<br>.<br>16 | SCORE_1<br>.<br>.<br>.<br>.<br>.<br>.<br>SCORE_12 | 38<br>.<br>.<br>.<br>.<br>.<br>.<br>38 | CHARACTER | MATCH RECORDS: FIELD SCORE_1 CONTAINS THE HOME TEAM ID AND FIELD SCORE_2 CONTAINS THE VISITING TEAM ID. ALL OTHER SCORE_X FIELDS ARE EMPTY.<br><br>PLAYER RECORDS: FEATS ACCOMPLISHED BY EACH PLAYER, COMMA DELIMITED. EACH FEAT WILL BE IDENTIFIED BY A HEADER CONSISTING OF A LETTER IDENTIFYING THE FEAT (TO BE DETERMINED) FOLLOWED BY A CHARACTER IDENTIFYING THE GAME (3=301,5=501,C=CRICKET). THESE TWO CHARACTERS WILL BE FOLLOWED BY THE VALUE OF THE FEAT ACCOMPLISHED BY THE PLAYER. |

FIG - 33

| POSITION | DESCRIPTION | DATA DOMAIN | REPRESENTING |
|---|---|---|---|
| 1 | GAME TYPE | 3<br>5<br>C | 301<br>501<br>CRICKET |
| 2 | GAME OPTIONS | A<br>I<br>O<br>D<br>M<br>C<br>L<br>K | ANY IN - ANY OUT<br>301 DOUBLE IN<br>301 DOUBLE OUT<br>301 DOUBLE IN DOUBLE OUT<br>301 MASTERS OUT<br>CRICKET CUT-THROAT<br>CRICKET LIMIT<br>CRICKET MARK 21 |
| 3 | BULL LEVEL PLAY | S<br>D | SINGLE BULL<br>DOUBLE BULL |
| 4 | NO. OF BOARD POSITIONS PLAYED | 1-4 | |
| 5 | NO. OF PLAYERS PER POSITION | 1-2 | |
| 6-9 | ROTATION | 1,2,3,4<br>A,B,C,D | HOME TEAM PLAYERS<br>VISITOR TEAM PLAYERS |

AUTOMATED LEAGUE AND TOURNAMENT SYSTEM FOR ELECTRONIC GAMES

This is a continuation of Ser. No. 08/303,604 filed on Sep. 9, 1994, which is now U.S. Pat. No. 5,593,349, issued on Jan. 14, 1997.

TECHNICAL FIELD

This invention relates in general to electronically scored amusement games and in particular to league and tournament play using such games.

BACKGROUND OF THE INVENTION

The advent of electronic dart machines brought with it the automation and consequent simplification of scoring. Not only do these dart machines obviate the need for players to track the score as a game progresses, but they also eliminate intentional and inadvertent scoring errors that could otherwise occur as a result of mathematical miscalculation on the part of the players. Additionally, built into these dart machines are other features that reduce the amount of attention that the players must direct to procedural aspects of game play. For example, once all of a player's darts have been thrown for a particular round, the dart machine can be advanced to begin scoring for the next player and will automatically indicate which player is to throw next. Additionally, these dart machines sometimes include an infrared sensor to automatically change scoring to the next player by sensing when a person moves into close proximity to the dart machine to remove the darts from the machine's target (dart board). Because of these conveniences, players need do little more than strategize and throw their darts.

These advantages have made electronic dart machines well suited for use in league and tournament play. However, scoring of individual games is but one aspect of league and tournament play. Operation of a league or tournament additionally involves administrative matters, such as organization of players into teams, determining matches and player rotations for games within each match, and combining the results of game and match play for statistical purposes (such as handicapping) and to determine future player pairings and an ultimate winner. Accordingly, it has been proposed to link together electronically scored amusement games for the purposes of automating the scoring of league and tournament play and permitting such play using amusement games located in remote locations. See, for example, U.S. Pat. No. 5,083,271 to Thatcher et al. which shows such a system for electronically scored amusement games in general, and U.S. Pat. No. 5,114,155 to Tillery et al. which is directed to electronic dart machines in particular.

One problem inherent in the systems disclosed in these two patents is that in order to implement league or tournament play, the organization and pairings for the first round of matches must be handled by a central computer prior to play of that first round. That is, a participant must first register and then be worked into the first round pairings by the central computer. Otherwise, information regarding the participants, which matches they played, and in what player position must be manually recorded and then later manually entered and associated with the game results uploaded to the central computer. This is disadvantageous because it may be desirable to permit league participants not only to register and organize themselves into teams using the dart machines at the remote locations, but also to then immediately begin league play without having to wait for the registration of all participants and determination of player and team pairings by the central computer.

In the systems disclosed in these two patents, the league and/or tournament database, which includes such information as teams, players, player handicaps, type of game played for that league, game options, and player rotation order, is not shared with the individual electronic dart machines that form part of league and tournament system for any purpose other than display on a monitor at the remote locations. This is disadvantageous for several reasons. First, once a participant has been registered and entered into the database at the central computer, that participant's identification must be provided to the electronic game prior to each scheduled match, necessitating that the participant either carry a player card or remember an ID or password that is manually entered into the dart machine. Second, player handicaps maintained by the central computer are not provided to the dart machines and implemented automatically by the software that runs game play. Third, the league/tournament database information is not used by the dart machine to control the game selection and set-up. Rather, participants must manually choose the games and game options.

The introduction of electronic dart machines has also brought with it certain problems. Among these are: 1) permitting the play and scoring of a multitude of different games that can be played on conventional dart boards; 2) providing a simple user interface for selecting among the multitude of different games and game set-ups; and 3) implementing player handicaps. The difficulty in permitting play of a multitude of games arises in part from limitations inherent in the scoring displays utilized by electronic dart machines. For example, electronic dart machines usually include a matrix scoring display for the conventional game of cricket, with groups of three mark indicator lights being permanently designated 20, 19, 18, 17, 16, 15, and bullseye for each of up to four players. The problem with such a scoring display is that it does not permit display of the scoring of marks for other variations of cricket in which numbers other than 15 through 20 are used as the targeted numbers. Also, as the choice of games to play on electronic dart machines has continued to increase, the user interface necessary to permit selection and set-up of those games has become more complicated and burdensome for the player. For electronic dart machines, that user interface typically involves one or more selection buttons or switches on the machine cabinet with the various games and options pre-printed on the cabinet face. Selection of a game and/or option is indicated by, for example, an LED located adjacent each of the pre-printed game and option selections. Such an arrangement makes it difficult to indicate which of the printed options apply to which of the games.

Implementing player handicaps on electronic dart machines creates several problems. First, players have different handicaps depending upon the type of game being played and upon whether the game is being played under the American Dart Association (ADA) or National Dart Association (NDA) rules. For instance, the ADA utilizes a points per dart handicap that is used to modify the player's starting score, whereas the NDA utilizes spot handicapping where the player gets to throw and score one or more darts prior to commencement of the game. To implement such handicaps on conventional electronic dart machines, the handicaps must be entered using the machine's target during the first round of game play. However, since the game treats the handicap as points scored during game play, statistical analysis of the players' game scores (e.g., points per dart) is incorrectly and undesirably influenced by their handicap. Thus, a player's handicap prior to game play would affect the determination of that player's updated handicap after game play.

SUMMARY OF THE INVENTION

In accordance with the present invention, there is provided a league and tournament system that utilizes one or more communication paths to transmit league related information between a centralized league machine and a plurality of electronically scored amusement games. The invention is particularly adapted to implementation of leagues and tournaments that utilize electronic dart machines, although it will be appreciated that many of the features of the invention are applicable to electronically scored amusement games in general, including video games, pinball machines, and others. League information, including team and player information, is shared between the league machine and dart machines so that the dart machines can utilize the league information for various purposes such as permitting player and team identification via a menu driven user interface, automatically controlling the selection and setup of games, controlling player rotation, and automatically implementing player handicaps.

Transmission of data from the league machine to the dart machines can be by modem or via a portable data storage device that communicates with the league machine and dart games using encoded, modulated, infrared light. Transmission from the dart machines to the league machine can be by fax, modem, or the portable data storage device.

In accordance with another aspect of the invention, the dart machines include a monitor that provides context-sensitive menus that simultaneously display multiple levels of the menu hierarchy. Selection between the menu items at each level of the hierarchy is provided using buttons located about the menu in positions that correspond to the displayed positions of their associated menu items. This arrangement provides a convenient and flexible interface that the dart machine to present a complex hierarchial menu structure in a simple and intuitive manner.

In accordance with another aspect of the invention, the dart machines utilize a card reader that accepts barcoded or other read-only cards for providing a plurality of functions, including player identification, game crediting, and game servicing.

In accordance with yet another aspect of the invention, the dart machine provides automatic handicapping by enabling the entry of handicaps into the dart machine and then either applying the handicaps to the scores or controlling the game play routine, depending upon the type of handicapping utilized. Thus, implementation of handicaps is controlled by the dart machine and is done prior to commencement of the game. This allows the handicaps to be used with the electronic scoring features of the dart machine without those handicaps being treated as a part of the player's score. Thus, use of the handicaps does not undesirably affect the statistical analysis of the player's scores that is used for such purposes as determining updated handicaps.

In accordance with another aspect of the invention, the dart machine includes an upper display that has changeable cricket segment numbers for variations of cricket that do not use the traditional 15–20 segments.

In accordance with the present invention, there is provided several other advantageous features of electronic dart machines. For example, digital control of speaker volume is provided. Also, the dart machine includes a body sensor that, using software, can be put into either a conventional "player change" mode or an attract mode to attract the attention of prospective players.

BRIEF DESCRIPTION OF THE DRAWINGS

A preferred exemplary embodiment of the present invention will hereinafter be described in conjunction with the appended drawings, wherein like designations denote like elements, and:

FIG. 6 depicts a signup sheet used to register players and provide barcoded player cards for use in league and/or tournament play;

FIGS. 29–33 show the formats for the files transmitted between the league machine and dart machines of FIG. 1.

DESCRIPTION OF THE PREFERRED EMBODIMENT

Figure 1:
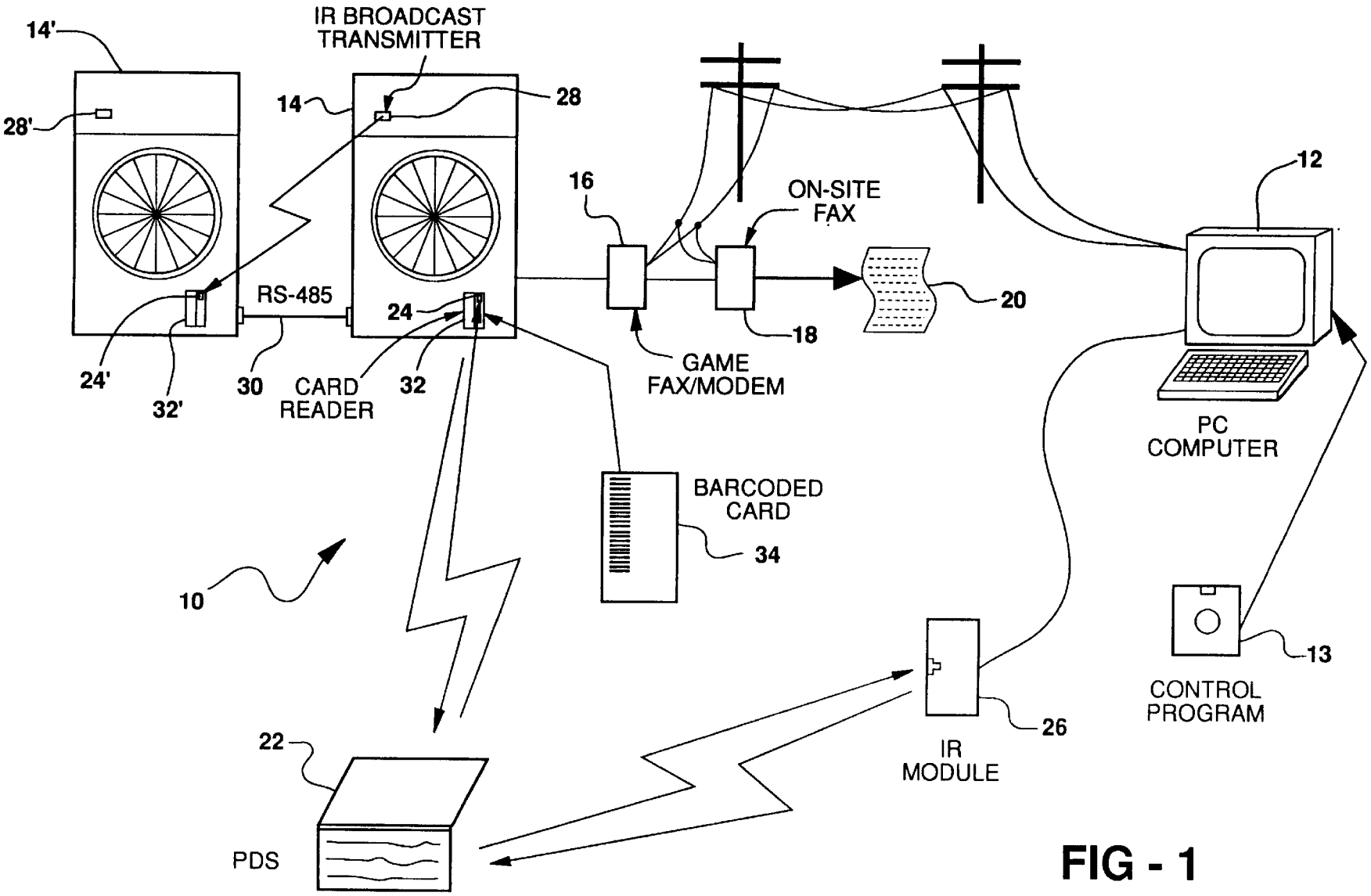
FIG. 1 is a diagrammatic view showing an embodiment of the league and tournament system of the present invention, including various communication paths that can be utilized by the system.

As shown in FIG. 1, a dart league and tournament system 10 of the present invention utilizes a personal computer 12, referred to hereafter as league machine 12, operating under control of a computer program 13 to communicate with a plurality of electronic dart machines 14 via one or more communication mediums. Although FIG. 1 depicts two dart machines 14 and 14' located at a single establishment with league machine 12 at a remote location, it will of course be appreciated that a multitude of dart machines 14 could be interlinked as a part of system 10 and that league machine 12 and each of the dart machines 14 can be located either at a single location or at various locations for which hardwiring of league machine 12 and dart machines 14 would be impractical.

In the illustrated embodiment, there are different communication schemes available for transmitting data from the dart machines 14 to league machine 12. The first scheme uses simple modem communication between dart machine 14 and league machine 12. It utilizes a game modem (or fax/modem) 16 at the location of dart machine 14 to transfer data to league machine 12, which includes an internal fax/modem (not shown). The second scheme involves sending data from dart machine 14 to league machine 12 via facsimile transmission. This scheme is referred to hereafter as direct facsimile communication. It utilizes fax/modem 16 and the fax/modem within league machine 12 and may also utilize a facsimile machine 18 located on site to provide a hard copy of the match results, as indicated at 20. The third scheme uses on-site fax 18 to provide a hard copy 20 of the match results for signature by the team captains or others which is then sent by facsimile transmission to league machine 12 using on-site fax 18. This scheme is referred to hereafter as double facsimile communication. The fourth scheme uses a portable data storage (PDS) device 22 to transfer data from dart machine 14 to league machine 12. This scheme is referred to hereafter as PDS communication. It utilizes infrared communication between PDS 22 and an infrared (IR) link 24 on dart machine 14 and between PDS 22 and an infrared (IR) interface module 26 at league machine 12. The first (modem) and last (PDS 22) of these schemes are available for transmitting data from league machine 12 to dart machine 14. These communication schemes will be described in greater detail below and it will be appreciated that these schemes could also be implemented together to increase the flexibility for the user of system 10. For example, data could be transferred from league machine 12 to a dart machine 14 via fax/modem 16 with data being transferred from the dart machine 14 to league machine 12 using PDS 22.

Intergame communication within a single establishment is likewise implemented using a wireless communication medium, a hardwired connection, or both. Wireless communication uses an infrared (IR) broadcast transmitter 28 that provides one-way communication with the IR link 24 of other dart machines 14 that are either within its line of sight or are accessible through reflections of the transmitted infrared signal. Hardwired communication is over an RS485 cable 30 that interconnects each of the local dart machines.

To simplify access to various data and functions associated with dart machine 14, each dart machine includes a card reader 32 that coacts with a barcoded or other, preferably read-only, data storage card 34. As will be discussed in greater detail below, dart machine 14 is programmed to respond to any of a number of types of barcoded cards 34 for such purposes as identifying league and tournament participants, providing game credits, and providing access to dart machine servicing functions.

One feature of the dart league and tournament system 10 is that the league or tournament database is not only held at league machine 12, but is shared with the electronic dart machines 14 that form part of league and tournament system 10. That is, each dart machine 14 has the complete list for a particular league of the teams, players, player handicaps, type of game played for that league, game options, player rotation order, and any other data relevant to league or tournament play. This provides a number of advantages over league or tournament systems that upload game results information from the electronic dart machines, but that do not provide the league database to the individual machines. First, identifying a participant at the outset of a scheduled match does not require a player card nor that the participant carry or remember an ID or password; rather, the participant can select his name at the dart machine from among a list of participants. Second, player handicaps can be maintained and periodically updated by league machine 12 and then be used by dart machine 14 to automatically implement the handicaps using the method adopted by the association under whose rules the league is being conducted. Third, the league database information could be used by the dart machine to control the game selection and set-up so that when players for a league match sign onto a dart machine (either by a player card or by selecting their name from the machine's menus), the dart machine automatically selects the game (e.g., 301) and the game options (e.g., double in/out) and implements the player rotations used by that league. Fourth, league or tournament registration can be handled at the dart machine the first night of match play without the need to utilize league machine 12. The sharing and use of the league database that provides these advantages will be described in great detail below.

Electronic Dart Machine

Figure 2:
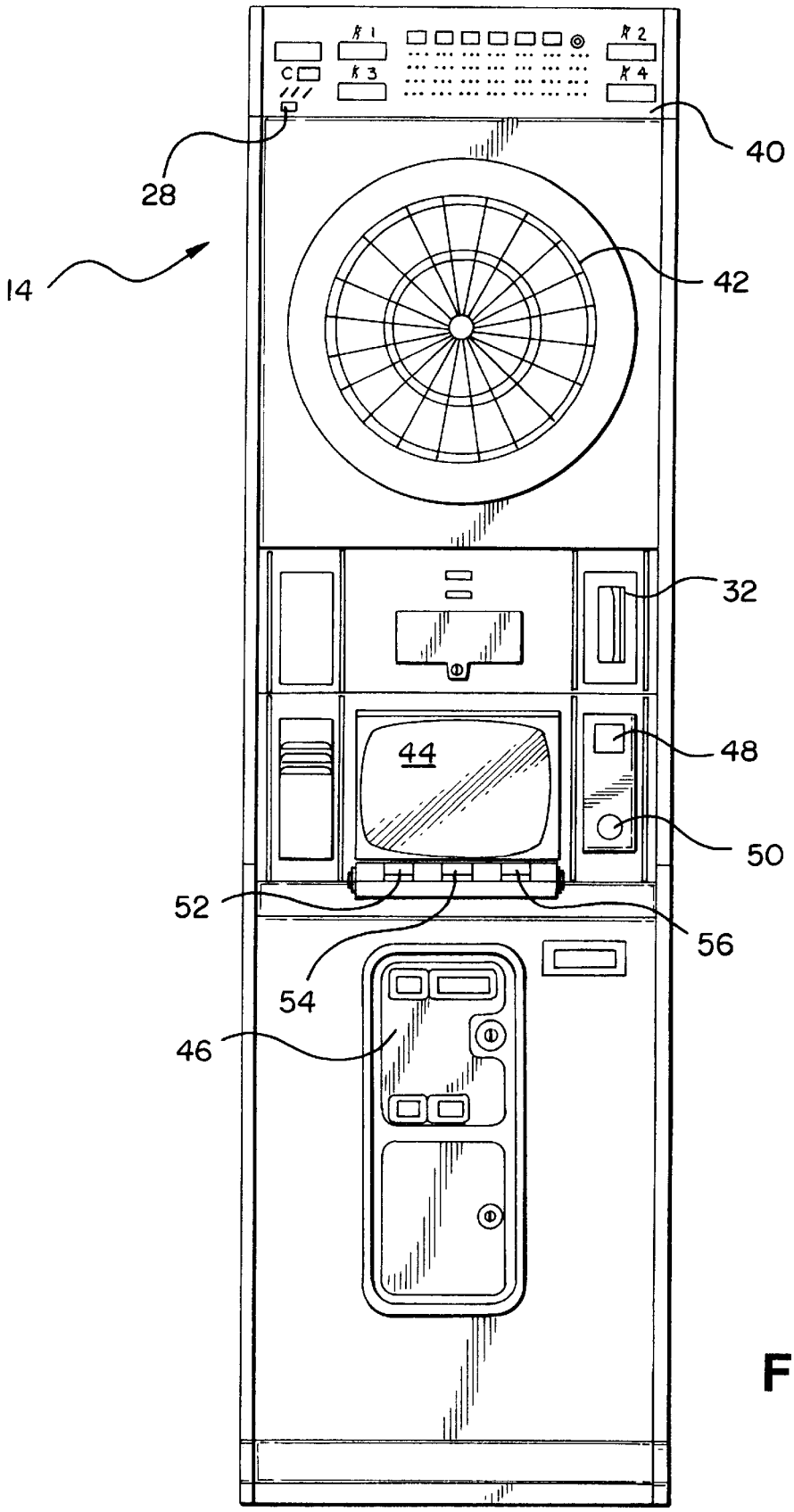
FIG. 2 is a front view of an electronic dart machine used in the system of FIG. 1.

The construction of electronic dart machine 14 will now be described in connection with FIGS. 2–13. FIG. 2 shows the layout of dart machine 14. It includes an upper display 40, a target 42, card reader 32, a monitor 44, and a conventional coin and bill acceptor 46. Target 42 can be a conventional electronic target having target segments that provide a signal whenever the segment is struck by a dart. See, for example, U.S. Pat. No. 4,586,716, issued May 6, 1986 to R. J. Brejcha et al., and U.S. Pat. No. 4,836,556, issued Jun. 6, 1989 to D. P. DeVale et al. The disclosures of these patents are hereby incorporated by reference. Monitor 44 is a standard fourteen inch VGA compatible monitor. Associated with monitor 44 are five switches or buttons used by a player to interact with the information presented on monitor 44. These buttons include a player change button 48 and a select button 50 located to the right of monitor 44 as well as three menu buttons 52, 54, 56 located along the bottom of monitor 44. As will be described below, the location of buttons 52–56 is predetermined in accordance with a set of menus that are displayed on monitor 44.

Figure 3:
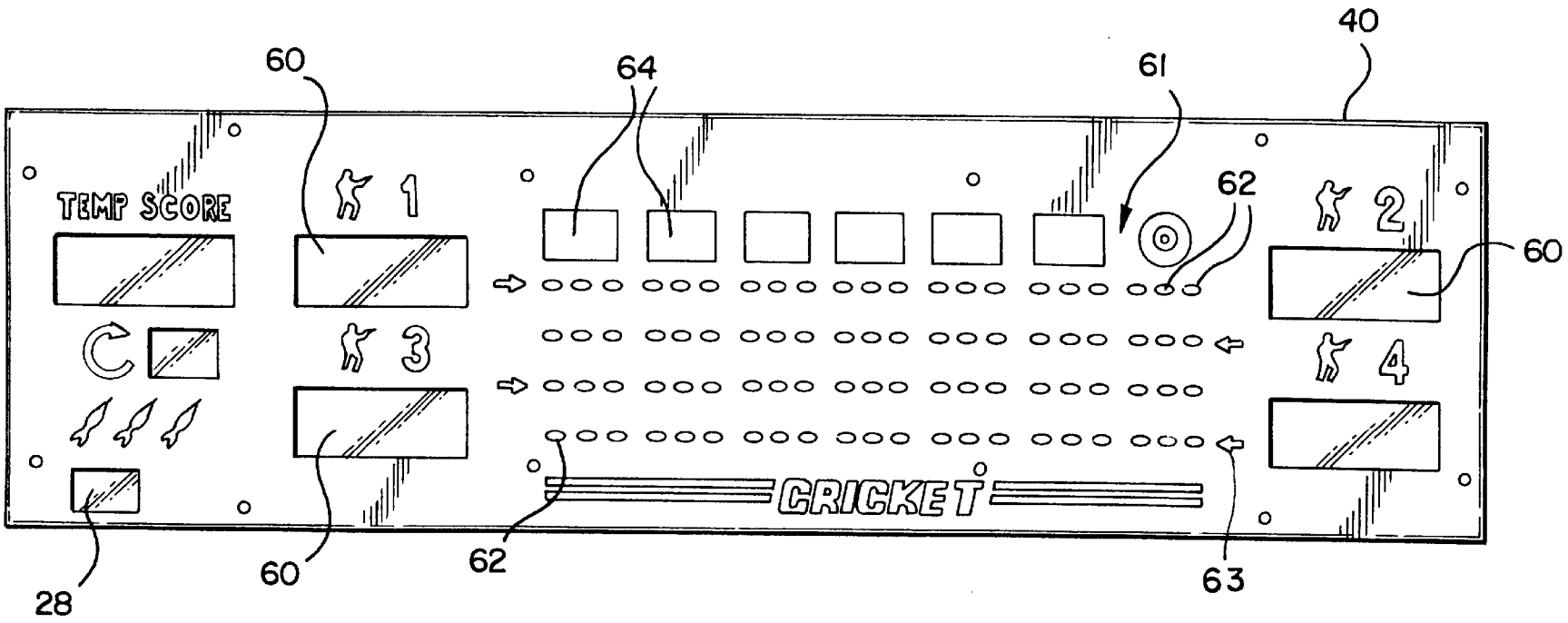
FIG. 3 is a front view of the upper display of the dart machine of FIG. 2.

Referring now to FIG. 3, upper display 40 is shown. It contains four, three and one-half digit seven-segment LED displays 60 for simultaneously displaying scores of up to four players. Upper display 40 also contains a centrally located cricket scoring matrix 61 of LEDs 62. Matrix 61 is separated into seven columns of twelve LEDs 62 that are arranged into four horizontal rows of three LEDs each. Each of these columns corresponds to one of the seven segments of target 42 utilized in the play of cricket. Each of the four rows of LEDs 62 corresponds to one of the four potential players, as indicated by the arrows 63 that are illuminated to indicate which row is being used to score the darts at any particular instant. This arrangement allows the players to quickly and easily determine their standing relative to other players. Also, unlike conventional electronic dart machine scoring displays that contain pre-printed cricket segment numbers fifteen through twenty, upper display 40 includes seven-segment LED displays 64. LED displays 64 can be used to display the traditional cricket segment numbers, but also permit scoring of variations on the traditional game of cricket that may use segments of target 42 other than fifteen through twenty. Upper display 40 also includes IR transmitter 28 which is located behind a protective window on upper display 40. LED displays 64 can be implemented using any suitable number display, such as an HDSP 5603, manufactured by Hewlett Packard, or a DUG14C, manufactured by Sunscreen. LEDs 62 can be any commonly available discrete LEDs.

Figure 4:
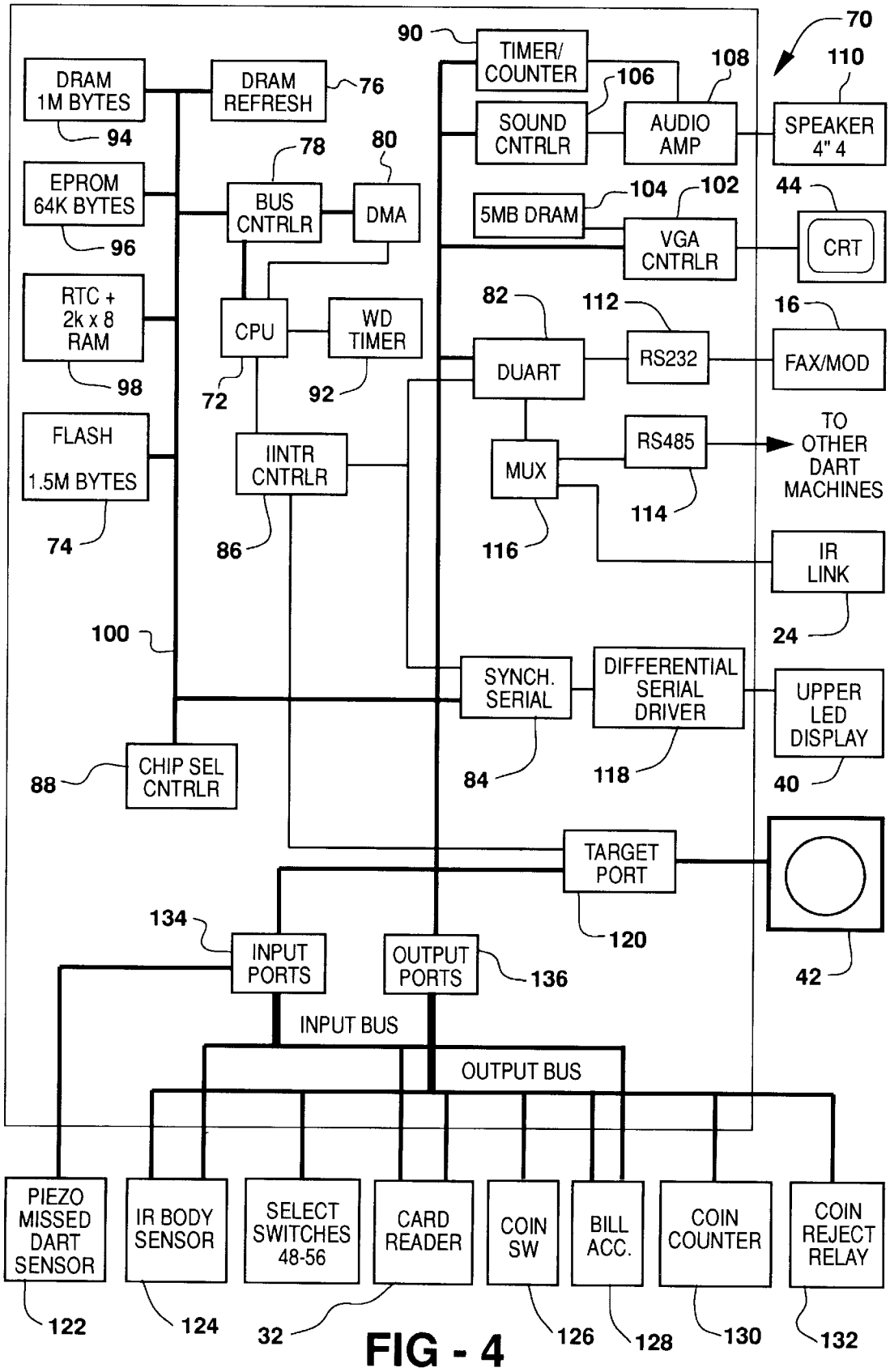
FIG. 4 is a block diagram of the electronics within the dart machine of FIG. 2.

With reference to FIG. 4, dart machine 14 includes an electronic circuit 70 which will now be described. In general, it is a microprocessor based system with a CPU 72 that is operable to execute a main program stored in non-volatile Flash memory 74. It includes a conventional power supply (not shown) that derives the various ac and dc voltages needed to power its components as well as other external circuits, such as card reader 32. Preferably, circuit 70 utilizes an Intel i386EX embedded microprocessor, which is a chip that incorporates the basic Intel 386 CPU (i.e., CPU 72) along with: a DRAM refresh circuit 76; a bus controller 78, a DMA controller 80; a dual UART 82; a synchronous serial port 84; an interrupt controller 86; a chip select controller 88; a timer counter 90; and a watch dog timer 92. The components of the Intel i386EX microprocessor are shown individually to indicate their incorporation into circuit 70. Flash memory 74 is a 1.5 MB memory consisting of three 256Kx16 chips, such as PA28F400BX chips, available from Intel. Flash memory is used to provide non-volatile, writeable storage of the main program, thereby allowing the program to be changed later if new programming of dart machine 14 is desired or necessary. As will be appreciated, reprogramming of Flash memory 74 can be done remotely, such as via modem 16. Flash memory 74 can also be used for non-volatile storage of league and match results data (i.e., league, team, and player information, as well as game and match results) and other machine performance data.

Circuit 70 includes a 1 MB DRAM memory 94 that is used by the main program for such purposes as variable storage and to build menu screens for monitor 40 where such screens involve more than a single bit-mapped image. DRAM 94 can consist of eight 256Kx4 chips, such as MB81C4256A-70PJ or MB814400A-70PJ, available from Fujitsu. Circuit 70 also includes a 64 KB EPROM 96, such as a TMS 27C512-10JL manufactured by Texas Instruments, that stores a program to handle reprogramming of Flash memory 74. Circuit 70 further includes 2 KB of a battery backed-up RAM 98 that is used by the main program where fast, non-volatile storage of data is needed. RAM 98 is particularly well suited for storage of in-progress game data, such as scores, rounds and marks that can be retained in the event of a power failure and then rebuilt when power is restored. RAM 98 further includes a real time clock that can be accessed by CPU 72. RAM 98 can be a MK48T02B15, manufactured by SGS, or a DS1642-150, manufactured by Dallas Semiconductor. Access by CPU 72 and other I/O to data in memories 74 and 94–98 is provided by way of a data bus 100.

Control of monitor 44 is achieved using a VGA controller 102 which can be implemented using a Trident VGA chip, such as the TVGA9000, and 512 KB of DRAM memory 104 which can be provided by two MB81C4256A-70PJ chips, available from Fijitsu. Sound generation is provided by way of a sound controller 106 that feeds an audio amplifier 108 which drives a four ohm speaker 110. Sound controller 106 and audio amplifier 108 will be described in greater detail below. Game fax/modem 16 is an external peripheral that communicates with circuit 70 via DUART 82 and an RS232 link 112 and that can be physically located within or without electronic dart machine 14. RS232 link 112 can be implemented using a DS14C88 RS232 Transmitter and DS14C89 RS232 Receiver, both manufactured by National Semiconductor. DUART 82 also provides two-way communication to other local electronic dart games via an RS485 link 114 that is multiplexed to DUART 82 along with IR link 24 using a multiplexor (MUX) 116, which can be a CD4052 dual 4-to-1 multiplexor/demultiplexor. RS485 link 114 can be a DS75176BN RS485 Transceiver, manufactured by National Semiconductor.

Upper display 40 is controlled via synchronous serial port 84 using differential line drivers 118 such as DS96174 quad differential line drivers, manufactured by National Semiconductor. Display data provided by way of line drivers 118 are received within upper display 40 using differential line receivers (not shown), such as SN75175. LED displays 62 and 64 and discrete LEDs 62 are driven using a display driver (not shown), such as the MAX7219 manufactured by Maxim, which can drive up to 64 discrete LEDs or LED segments arranged in an 8×8 array. Decoding of the LEDs is handled by the main program executing within circuit 70 using predefined tables that are set up according to the connections made at upper display 40 between the display drivers and the discrete LEDs and LED segments.

Circuit 70 includes a target interrupt I/O port 120 coupled to target 42 that provides an interrupt signal to CPU 72 in the event a target segment is activated, such as by being struck by a dart. The target segments of target 42 are strobed using four strobe lines that are driven by the open collector outputs of 7406 hex inverters located within target port 120. Target 42 has sixteen target segment outputs which are coupled to data bus 100 by target port 120 using buffers, such as 74ACT541 octal buffers. Interrupts are generated by target port 120 using 74HCT30 eight input NAND gates that have as their inputs the sixteen target segment outputs provided by target 42. The outputs of these NAND gates are provided to interrupt controller 86.

Circuit 70 further includes static I/O ports for interfacing with other external devices within dart machine 14, including a piezoelectric sensor 122, a passive infrared (IR) body sensor 124, the five switches 48–56 associated with monitor 44, card reader 32, one or more coin switches 126, a bill acceptor 128, a coin counter 130, and a coin reject relay 132. The last four of these are conventional devices that form a part of coin and bill acceptor 46. Piezoelectric sensor 122 is used to detect the impact of a thrown dart that has missed target 42 entirely. IR body sensor 124 is used to detect the presence of a player or potential player, as will be described below in greater detail. The static I/O ports comprise a set of input ports 134 and a set of output ports 136 connected to the external devices as shown depending upon whether those device provide input, output, or both. Preferably, interfacing via input ports 134 to switches 48–56, piezoelectric sensor 122, IR body sensor 124, coin switches 126, and bill acceptor 128 is implemented using 74ACT244 tristate octal buffers, manufactured by National Semiconductor. Output ports 136 comprise 74ACT11374DW octal D latches, manufactured by Texas Instruments, for sending data to upper display 40, piezoelectric sensor 122, and IR body sensor 124. Power for lamps used in card reader 32, switches 48–56, coin counter 130, and coin reject relay 132 is provided via output ports 136 using UCN5801 latched sink drivers, manufactured by Allegro MicroSystems Inc.

Figure 5:
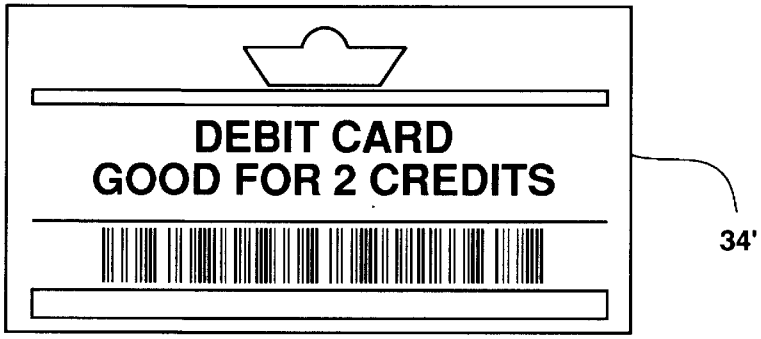
FIG. 5 depicts a barcoded card for use with the dart machine of FIG. 2.
Figure 11:
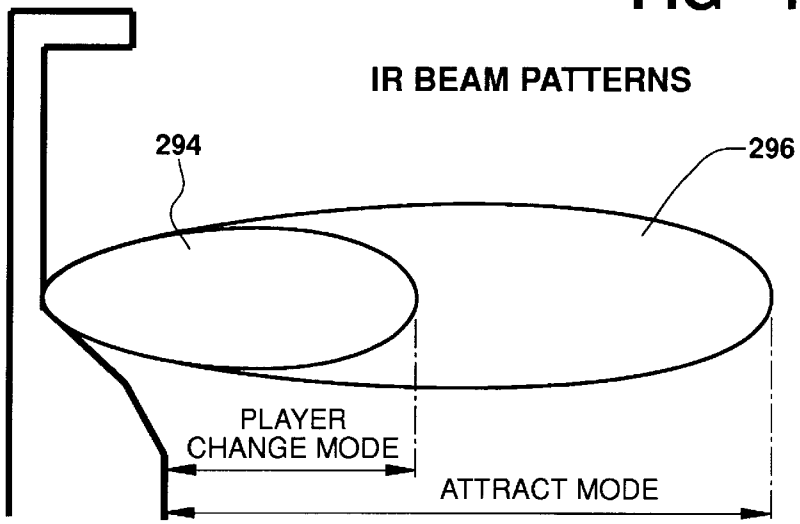
FIG. 11 is a diagrammatic view of the beam detect patterns used by the body detection circuit of FIG. 10.

Referring now to FIGS. 5–11, barcode cards 34 and card reader 32 will be described. FIG. 5 shows a typical debit card 34'. A debit card is utilized by swiping it through card reader 32, with one credit being given for each swipe of the debit card, up to the maximum number of credits provided by that card. Crediting by dart machine 14 is accomplished under control of the main program which stores a count of the number of times the debit card can be used in the card reader. The barcode on each debit card includes an identifier indicating that the card is a debit card (as opposed to a player card or other type of recognized card) and a pointer that identifies a unique memory location within the memory of circuit 70. The memory location corresponding to the debit card is intialized by a barcoded activator card that stores the maximum number of credits that the debit card is worth. Thus, when the debit card is swiped through the card reader, the main program detects that the card is a debit card using the identifier, then accesses the memory location corresponding to the pointer and, if the number stored at that location is greater than zero, decrements the number stored at that memory location and increments the number of game credits. Use of the card can be restricted to a particular game or, if the dart machines are interlinked using one of the communication paths of FIG. 1, can be available for all dart machines simply by updating the proper memory location of the other dart machines whenever the debit card is used. Further, initialization of credits in memory locations corresponding to a series of cards can be accomplished using a single barcoded activator card. Optionally, any of the other communication paths described above can be used to initialize the memory locations in dart machine 14 that correspond to the debit cards. Preferably, the barcodes are implemented using a 3 of 9 coding scheme.

FIG. 6 depicts a signup sheet 138 that can be used in setting up leagues to provide participants with a player card 34" immediately upon registering by filling out a signup card 139 that is associated with that player card. The sheet provides five player cards 34", including a team captain's card and a substitute's card. Stored in the barcode of each card is a unique ID that is associated with the player and the league operator. Since the league and tournament database is shared between league machine 12 and the dart machines, this ID can be used by dart machine 14 to access all relevant information concerning the participant to whom the card is assigned. This arrangement is advantageous because all the information necessary for league or tournament play can be accessed using a simple, inexpensive, read-only (e.g., barcoded) card. Such information can include the player's name, team, league, handicap, performance statistics, and game and pairing's information for match play.

Other types of barcode cards 34 can be utilized. For example, a service card could be used to gain access to various dart machine data, such as cash box receipts and how often and when the dart machine was used. This information could be displayed on monitor 44, either directly or via menu selections that are made available only after a service card has been swiped through card reader 32. Also, a service card could be used to initiate diagnostic routines or to command dart machine 14 to carry out certain functions. For example, a service card could be used to change the speaker volume, either by incrementing or decrementing the volume in steps or by providing access to a menu display that permits adjustment of the sound volume. Optionally, a team captain's card could be used to provide a sign-off for game results and/or to initiate transmission of match results to league machine 12.

Furthermore, the barcodes can be used in various ways to provide different commands to dart machine 14. For example, a service card that adjusts speaker volume could be swiped through card reader 32 in one direction to increase volume and in the other direction to decrease volume. For such an application, the main program within dart machine 14 would be written so as to determine which direction the barcode is being moved past the bar code reader and to determine the command or data encoded within the barcode. Optionally, swipe direction could be used to change the language (e.g., English or French) used in the menus and other text displayed on monitor 44. Additionally, the cards could contain multiple barcodes for these different functions. Other such uses and designs of barcode card 34 will become apparent to those skilled in the art.

Figure 7:
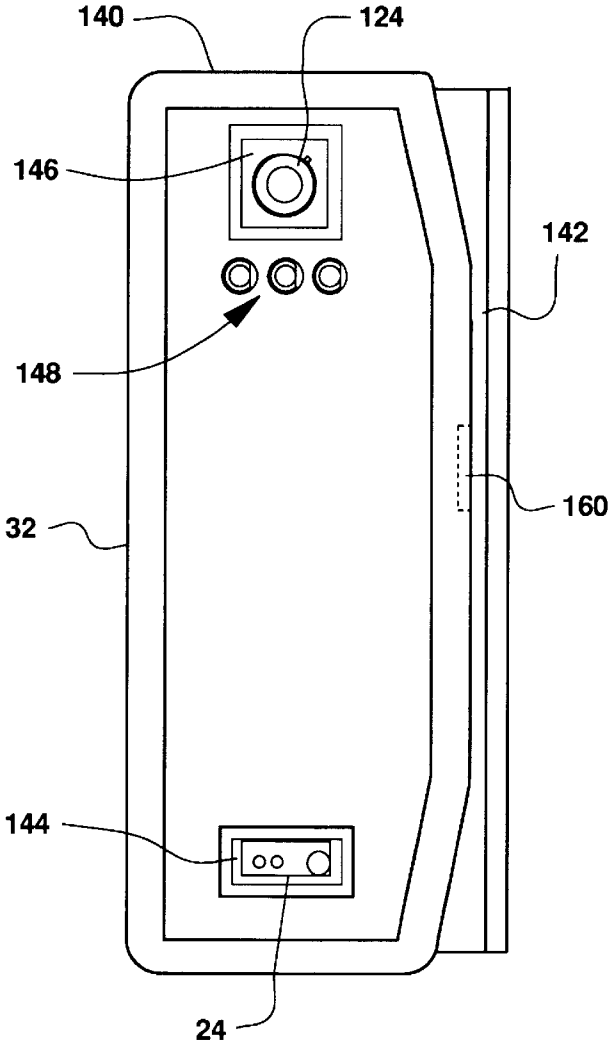
FIG. 7 is a front view of the card reader used in the dart machine of FIG. 2.

Turning now to FIG. 7, card reader 32 includes a housing 140 having a swipe channel 142 along its length along which a barcoded card can be swiped. Mounted at the lower end of card reader 32 behind an infrared filter 144 is IR link 24. Mounted at the upper end of card reader 32 behind a protective window 146 is IR body sensor 124. A set of status LEDs 148 are located underneath IR body sensor 124 and are used in a conventional manner to indicate the results of swiping a barcoded card along channel 142.

Figure 8:
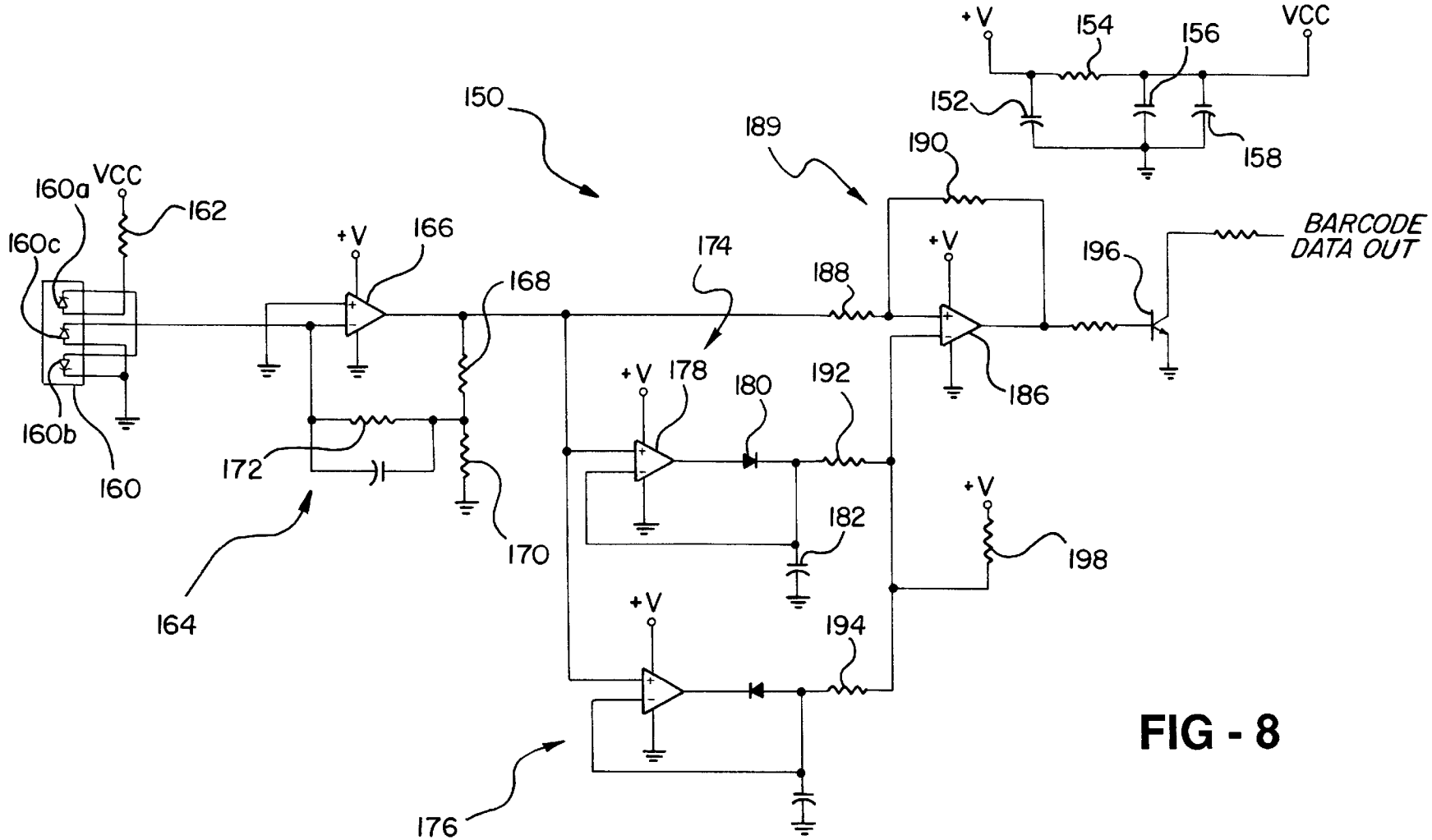
FIG. 8 is a schematic of a barcode reader circuit used by the card reader of FIG. 7.

Card reader 32 includes a barcode reader circuit 150 shown in FIG. 8. It utilizes a supply voltage VCC provided by circuit 70. VCC is filtered by a pair of capacitors 152 and 154 connected to ground and then through a resistor 156 and another capacitor 158 which is connected to ground. The voltage appearing across capacitor 158 is used as a second supply voltage +V. The transmission and reception of reflected light used for reading barcodes is provided using an optical sensor assembly 160 that includes two LEDs 160*a* and 160*b* that are set at forty-five degree angles relative to a photodiode 160*c* to provide illumination into channel 142 of card reader 32. Reflected light from a barcode is focussed onto photodiode 160*c* using a lens (not shown) and optical slit which determines the width of the area being sensed and therefore defines the resolution of barcode reader circuit 150. The amount of reflected light from a barcode moving through channel 142 varies with the alternating black and white lines of the barcode and the output current of photodiode 160*c* varies accordingly. LEDs 160*a* and 160*b* are connected in series with a current limiting resistor 162 between VCC and ground to provide continuous illumination into channel 142 of card reader 32. The cathode of photodiode 160*c* is connected to ground and its anode is connected to a transimpedance amplifier 164.

In particular, the anode of photodiode 160*c* is connected to the inverting input of an op-amp 166 having its non-inverting input connected to ground. Amplifier 164 uses resistors 168, 170, and 172 to provide a transfer characteristic of:

$$V_{out} = \left(\frac{(R_{168} + R_{170})R_{172}}{R_{170}}\right)I \tag{1}$$

where $V_{out}$ is the voltage at the output of op-amp 166. Positive peaks of this voltage indicate a white line of the barcode and negative peaks indicate a black line. This voltage is provided to a positive peak detector 174 and a negative peak detector 176. Positive peak detector 174 comprises an op-amp 178 that is connected as a unity gain amplifier with a blocking diode 180 in series with its output so that positive swings of the input to op-amp 178 produces a positive output that charges a capacitor 182. Discharging of capacitor 182 by negative swings that lower the output voltage of op-amp 178 is blocked by diode 180. Thus, capacitor 182 stores the positive peaks generated by amplifier 164. Negative peak detector 176 is constructed similarly, with its diode being connected oppositely to provide negative peak detection.

The voltage output of amplifier 164 is also provided to a comparator circuit 184 which comprises an op-amp 186 that has its non-inverting input connected to receive the output of amplifier 164 by way of a resistor 188. Comparator 184 also includes a resistor 190 connected between the output of op-amp 186 and its non-inverting input. The ratio of resistors 190 to 188 is sufficiently high to cause the output of op-amp 186 to swing between its supply rails. The outputs of peak detectors 174 and 176 are coupled to the inverting input of op-amp 186 by way of resistors 192 and 194, respectively, which act as a voltage divider. The relative values of resistors 192 and 194 are selected so that the reference voltage provided to the inverting input of op-amp 186 is above the negative peak voltage by approximately forty percent of the voltage differential between the positive and negative peaks. The values of these resistors are also chosen so that the discharge times of the capacitors of peak detectors 174 and 176 are much slower than the rate of infrared light fluctuations during a barcode read. The output of comparator 184 drives a transistor 196 which is turned on or off depending upon the output voltage of comparator 184.

Initially, when no barcode card is being used in card reader 32, the capacitors of peak detectors 174 and 176 will charge/discharge until they are at the same voltage. A pull-up resistor 198 connected between +V and the inverting input of op-amp 186 is used to insure that transistor 196 remains off in the presence of a steady state input from optical sensor assembly 160. Thus, the white margin of a barcode will provide a transition to circuit 70 prior to the carcode passing by sensor assembly 160, thus giving circuit 70 an opportunity to prepare for the barcode data. When a barcode is swiped through card reader 32, peak detectors 174 and 176 detect and hold the peaks, with those peaks being used to provide a reference voltage to comparator 184. The positive peaks output by amplifier 164 will be above the reference voltage and the output of comparator 184 will thus go to a high output level, switching transistor 196 on. The negative peaks output by comparator 164 will be below the reference voltage and the output of comparator 184 will thus go to a low output level, switching transistor 196 off. An external pull-up resistor (not shown) can be used to pull the voltage high at the collector of transistor 196 so that the output of barcode reader circuit 150 provides a logic zero level for white lines of the barcode and a logic one level for black lines of the barcode. Optical sensor assembly 160 preferably comprises an OTR691, manufactured by Opto Technology. The op-amps used for amplifier 164, peak detectors 174 and 176, and comparator 184 can each comprise one-fourth of a TLC274 quad op-amps, manufactured by Texas Instruments.

Figure 9:
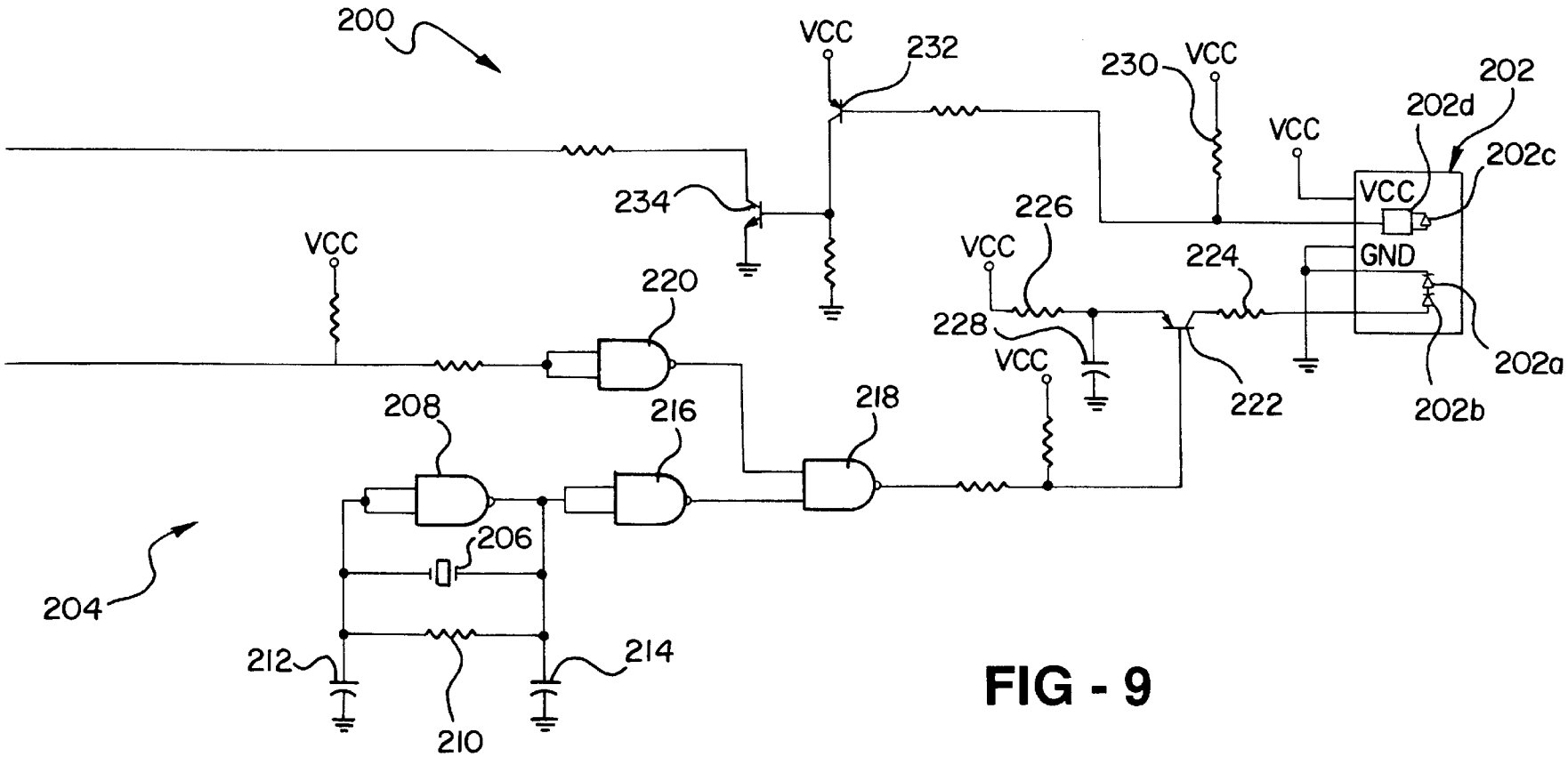
FIG. 9 is a schematic of an infrared data transceiver circuit located in the card reader of FIG. 7.

Referring now to FIG. 9, an infrared transceiver circuit 200 that comprises IR link 24 will be described. It utilizes an infrared transceiver 202, such as a RY5BD01, available from Sharp. Transmission is accomplished using a pair of series-connected infrared LEDs 202*a* and 202*b* that conduct current to ground. Transmission is by way of half-duplex asynchronous serial communication using amplitude shift keying (ASK) modulation of the transmitted infrared light. Modulation of the infrared light is provided by an oscillator 204 having a frequency set by a ceramic resonator 206. Preferably, the frequency of oscillator 204 is 500 KHz, which is above the modulation frequency utilized by consumer infrared remote controls which typically utilize modulation frequencies of 36–40 KHz. Ceramic resonator 206 is connected between the input and output of an inverter 208 and in parallel with a high valued resistor 210. The input and output of inverter 208 are each also coupled to ground through two identical capacitors 212 and 214. As will be appreciated by those skilled in the art, inverter 208 provides a pulse train at fifty percent duty cycle and at a frequency determined by resonator 206. This pulse train is buffered using another inverter 216.

To implement ASK coding, the pulse train from inverter 216 is gated according to the data being transmitted. This is achieved using a two-input NAND gate 218 which receives as one input the 500 KHz pulse train and as the other input the data to be transmitted. This data is sent from circuit 70 using DUART 82 and MUX 116 as described above. The data is inverted using an inverter 220 and then provided to one input of NAND gate 218. Thus, NAND gate 218 outputs bursts of 500 KHz oscillations. This output drives a pnp transistor 222 that provides the necessary drive current to LEDs 202*a* and 202*b* through a current limiting resistor 224. A low valued resistor 226 in series with the current supply to transistor 222 and a capacitor 228 provide a charge reservoir that minimizes power supply line noise due to current spikes resulting from the switching of transistor 222.

Reception of modulated infrared light is accomplished using a photodiode 202*c* within IR transceiver 202. As indicated, transceiver 202 includes demodulation and waveshaping circuitry 202*d* that provides a digital output data stream. Transceiver 202 has an open collector output that is pulled high by a resistor 230 and that is connected to the base of a pnp transistor 232. Transistor 232 in turn drives a transistor 234 whose collector is coupled back to circuit 70 to provide it with the received data. The collector of transistor 234 is pulled high by an external pull-up resistor (not shown). Resistor 230 normally maintains transistor 232 in a non-conducting state, resulting in transistor 234 remaining off such that its output is held high by the external pull-up resistor. When a burst of modulated infrared light is received by transceiver 202, it pulls its output low, switching transistor 232 on which in turn switches transistor 234 on, thereby pulling its collector voltage to a logic zero level. In this way data received via IR link 24 is provided to circuit 70.

Figure 10:
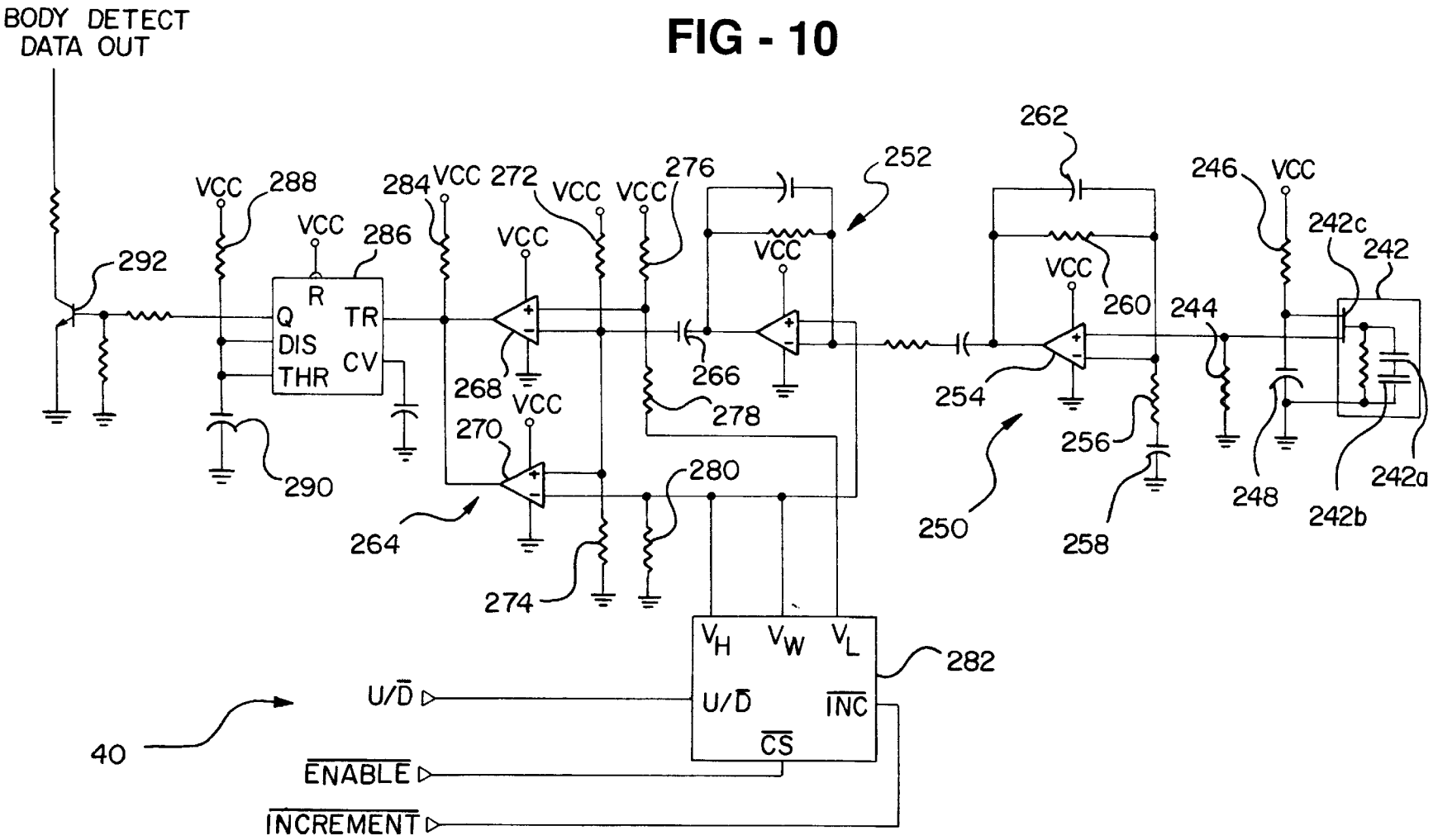
FIG. 10 is a schematic of a digitally controlled passive infrared body detection circuit located in the card reader of FIG. 7.

With reference to FIG. 10, the circuitry of IR body sensor 124 will be described. As mentioned above, IR body sensor 124 is used to detect the nearby presence of a person, as in the case, for example, of a player removing darts from the target after that player's turn is over. This information can be used in a conventional manner to automatically advance the player scoring so that the next darts thrown are scored for the next player. In the present invention, the main program of circuit 70 can also switch body sensor 124 into a second mode during periods of inactivity. In this second mode, body sensor 124 has a greater sensitivity to incoming infrared light and its output is used to initiate an "attract" function which involves generating voice and/or other audio as well as illuminating selected lights and displays for the purpose of attracting the attention of the detected potential player. Thus, body sensor 124 has two modes, a player change mode utilized during game play and an attract mode utilized when dart machine 14 is in an idle mode waiting to be played.

IR body sensor 124 is implemented using a passive infrared detection circuit 240. Infrared detection is provided by a pyroelectric detector 242, such as a P4488, manufactured by Hamamatsu. Pyroelectric detector 242 utilizes a crystal that is responsive to temperature changes to vary the surface charge on the crystal. It is suitable for detecting human body motion since it responds only to varying incident infrared light. Detector 242 utilizes a pair of pyroelectric detectors 242*a* and 242*b* that are connected in series with opposite polarities to cancel output changes due to changes in ambient temperature. Detectors 242*a* and 242*b* are housed in a metal can with a lens that passes only infrared light within the spectrum normally emitted by the human body. In response to incident infrared light of the proper wavelength, detector 242 switches on an internal field effect transistor 242*c* that provides current from the supply line VCC to a resistor 244 connected between its source and ground. A resistor 246 in series with the supply line for transistor 242*c* and a capacitor 248 connected between ground and the drain of transistor 242*c* prevent noise on the power supply line from appearing at resistor 244.

Fluctuations in the output of detector 242 appearing across resistor 244 are amplified and filtered by two identical bandpass filter stages 250 and 252. Stage 250 utilizes an op-amp 254 for amplification. This stage includes a resistor 256 and a capacitor 258 connected in series between ground and the inverting input of op-amp 254. The non-inverting input receives the voltage appearing across resistor 244. A resistor 260 and capacitor 262 are connected in parallel between the inverting input of op-amp 254 and its output. The ac gain of this stage is set by the ratio of resistor 260 to resistor 256 and is preferably about 48. The lower cut-off frequency is determined by resistor 256 and capacitor 258 and is preferably about 0.7 Hz at its −3 dB point. The upper cut-off frequency is determined by resistor 260 and capacitor 262 and is preferably about 7.2 Hz at its −3 dB point. The output of stage 250 is ac coupled to stage 252 which has the same gain and filtering characteristics as stage 250, the only difference being that stage 252 is configured as an inverting amplifier and has a dc bias applied to the non-inverting of its op-amp. The output of stage 252 is ac coupled to a dual comparator 264 by a capacitor 266.

Dual comparator 264 is configured as a window detector. It comprises a first op-amp 268 and a second op-amp 270, with the inverting input of op-amp 268 connected to the non-inverting input of op-amp 270 and to capacitor 266 to receive the time-varying output of stage 252. A bias voltage of one-half VCC is provided to these inputs using resistors 272 and 274. Resistors 276, 278, and 280 along with a 100-step digitally controlled potentiometer 282 are connected in series between VCC and ground to form a voltage divider which provides upper and lower thresholds. The lower threshold appears across resistor 280 and is provided both to the inverting input of op-amp 270 and the non-inverting input of the op-amp of stage 252 to provide it with the dc bias mentioned above. The upper threshold appears at the common node of resistors 276 and 278 and is provided to the non-inverting input of op-amp 268. The open collector outputs of op-amps 268 and 270 are connected together in a WIRED-AND configuration and are coupled to VCC via a pull-up resistor 284. When a voltage fluctuation outputted by stage 252 exceeds the upper threshold, op-amp 268 pulls its output to a logic zero level. Similarly, when a voltage fluctuation falls below the lower threshold, op-amp 270 pulls its output to a logic zero level.

The outputs of op-amps 268 and 270 are connected to the trigger input of a timer 286, such as LMC555, configured as a retriggerable monostable multivibrator. When triggered by a negative-going edge, timer 286 generates an output pulse having a pulse width determined by a resistor 288 and a capacitor 290. Preferably, this pulse width is approximately twenty milliseconds. The pulse from timer 286 is used to switch on a transistor 292 to provide an active low pulse that is provided to circuit 70. The op-amps used for stages 250 and 252 can each be a LM358 and op-amps 268 and 270 can comprise an LM393D dual comparator.

Software control of the two modes of infrared detection circuit 240 is achieved using the main program of circuit 70 which sends control signals to potentiometer 282 that cause it to increase or decrease the resistance between its $V_W$ and $V_L$ inputs (pins 5 and 6). For player change mode, this resistance is preferably set relatively high so that the window (i.e., the difference between the upper and lower thresholds) will be relatively large and only large infrared fluctuations sensed by detector 242 (such as occur when a person is moving within a few feet of detector 242) will trigger timer 286. For attract mode, this resistance is preferably set relatively low so that the window will be small and even minor infrared fluctuations sensed by detector 242 (such as might occur up to Six to nine feet from detector 242) will trigger timer 286. In this way, the sensitivity of IR body sensor 124 can be adjusted as desired. This can be seen diagrammatically in FIG. 11, which shows the infrared sensitivity ranges 294 and 296 for the player change and attract modes, respectively. Adjustments of potentiometer 282 can be made by activating the enable input and then applying a positive-going edge to the increment input. Resistance is increased when the up/down input is at a logic one level and is decreased when that input is at a logic zero level. Potentiometer 282 utilizes an EEPROM to store the selected resistance when power is removed. Potentiometer 282 can be a X9312, manufactured by XICOR.

Figure 12:
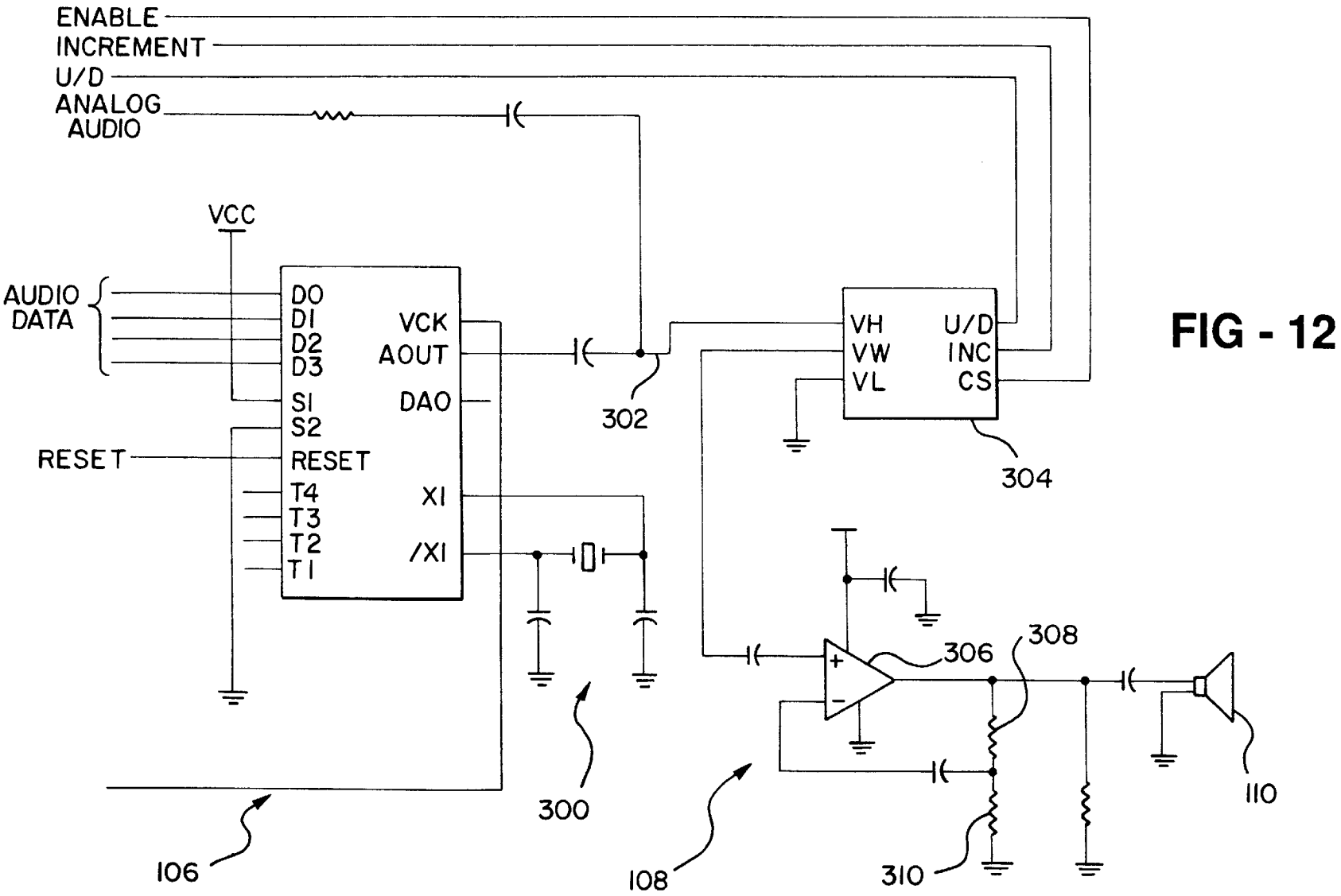
FIG. 12 is a schematic of a sound controller and audio amplifier that is used in the dart machine of FIG. 2 and that provides digital volume control.

Volume control for speaker 110 can also be handled in software using a second digitally controlled potentiometer. This is shown in FIG. 12 which schematically illustrates the essential circuitry of sound controller 106 and audio amplifier 108. Sound controller 106 utilizes an OKI MSM6585 ADPCM speech synthesis chip which receives digital sound data via data bus 100 in four bit segments. The four bit audio data can be provided by latching the data from data bus 100 and then using a multiplexor (e.g., a 4-bit 2-to-1 multiplexor for an eight bit data bus) to select among nibbles of audio data. Sound controller 106 uses a conventional oscillator circuit 300 and, using the audio data, generates analog audio output, as indicated by the signal AOUT. This output is ac coupled to a node 302 where it is mixed with an analog audio input. Volume control is achieved by a digitally controlled potentiometer 304 which can be the same as that used above in connection with IR body sensor 124. Potentiometer 304 is connected between node 302 and ground, with the wiper arm providing an audio output that is ac coupled to audio amplifier 108.

Amplifier 108 comprises an op-amp 306 with its non-inverting input receiving the audio output from potentiometer 304. The output of op-amp 306 is provided across a voltage divider comprising resistors 308 and 310. The voltage across resistor 310 is ac coupled to the inverting input of op-amp 306. The relative values of resistors 308 and 310 determine the ac gain of amplifier 108. Preferably, the gain is approximately one hundred. The output of op-amp 306 is used to drive speaker 110. As will be appreciated, adjusting the position of the wiper arm of potentiometer 304 along the resistance between node 302 and ground adjusts the voltage level of the audio output of potentiometer 304 and thus, the volume of the sound generated by speaker 110.

Figure 13:
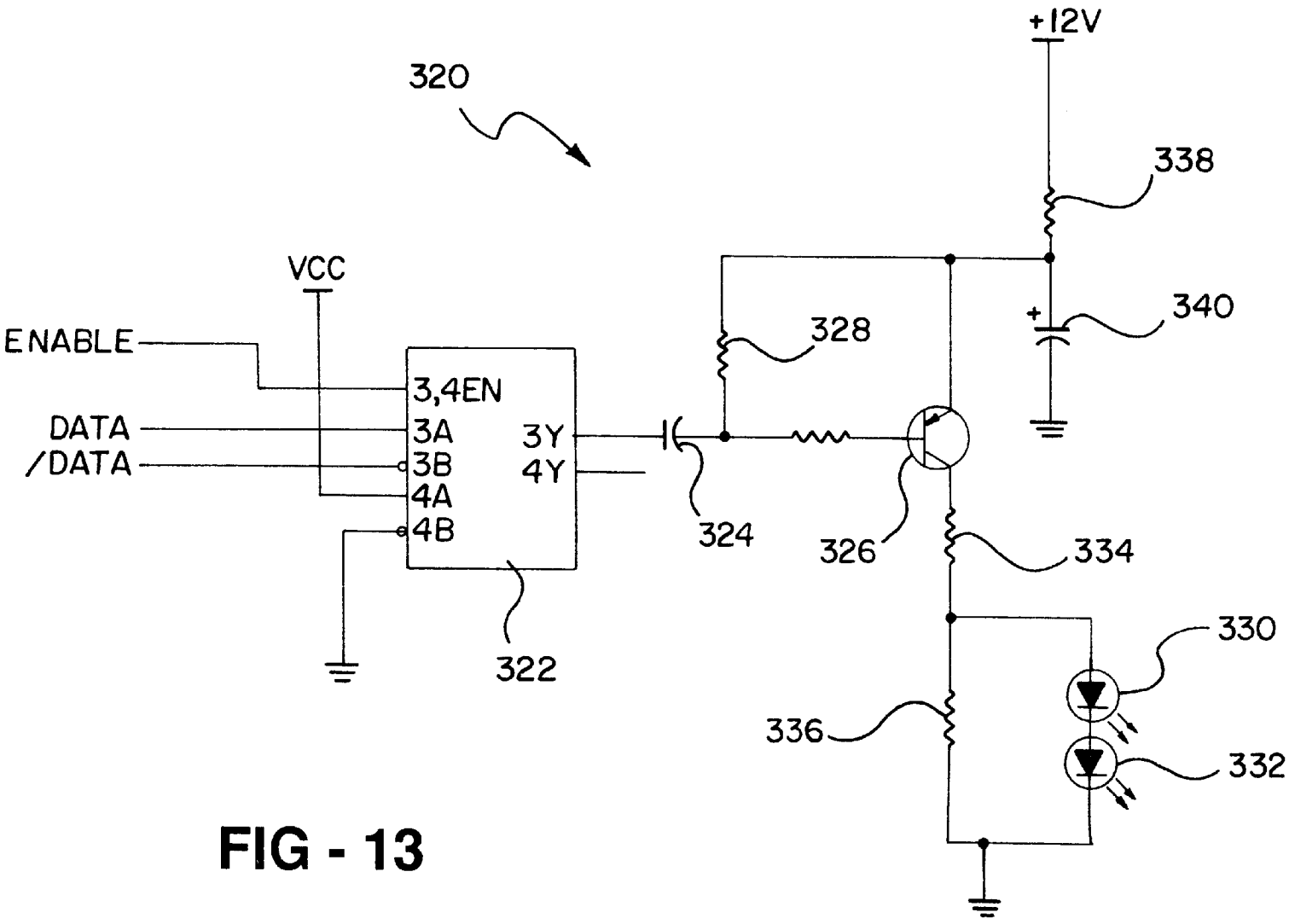
FIG. 13 is a schematic of a broadcast infrared transmitter circuit used by the dart machine of FIG. 2 for intergame communication.

Turning now to FIG. 13, a circuit 320 for implementing IR broadcast transmitter 28 is shown. As mentioned above, IR transmitter 28 communicates with IR link 24, which is described above in connection with FIG. 9. Accordingly, IR transmitter 28 also utilizes amplitude shift keying (ASK) with a modulation frequency of 500 KHz. The 500 KHz pulse train is encoded with the desired data by circuit 70 and is sent serially by differential line drivers 118 to a differential line receiver 322, such as an SN75175. Received data is provided on the output of line receiver 322 when its enable line is activated. This data is ac coupled by a capacitor 324 to a pnp transistor 326. A pull-up resistor 328 normally maintains transistor 326 in a non-conducting state. Whenever the encoded 500 KHz pulse train is provided at the output of line receiver 322, transistor 326 switches on and off, supplying current to a pair of series connected IR LEDs 330 and 332. A resistor 334 in series with the collector of transistor 326 limits the current through LEDs 330 and 332. To reduce the effects of the junction capacitance of LEDs 330 and 322 and thereby provide sharp edges during the switching of LEDs 330 and 332, circuit 320 includes a resistor 336 in parallel with LEDs 330 and 332. A small resistance 338 placed in series with the +12v supply line and a large capacitor 340 between the emitter of transistor 326 and ground minimizes power supply line noise due to current spikes resulting from the switching of transistor 326.

Operation of the League Machine

As mentioned above, league machine 12 comprises a personal computer having an internal fax/modem to send and receive data via modem or facsimile transmission. For infrared data transmission using the portable data storage (PDS) device 22, an IR module 26 is connected to league machine 12. Preferably, league machine 12 utilizes a '486 series microprocessor, such as are available from Intel. PDS 22 preferably comprises a Wizard OZ9520 and IR module 26 preferably comprises a CE-IR2 wireless interface, both of which are available from Sharp. In the event that direct or double facsimile transmission is used to transfer data from dart machine 14 into a hard disk or other memory at league machine 12, an optical character recognition (OCR) program, such as BitFax Professional Version 3.07 made by Bit Software, Inc., is run on league machine 12 to convert the bit-mapped data into ASCII. Alternatively or optionally, the data to be transmitted to league machine 12 could be embodied using the glyph coding developed by Xerox and a suitable image analysis program could be used to extract the data from the glyphs.

Figure 14:
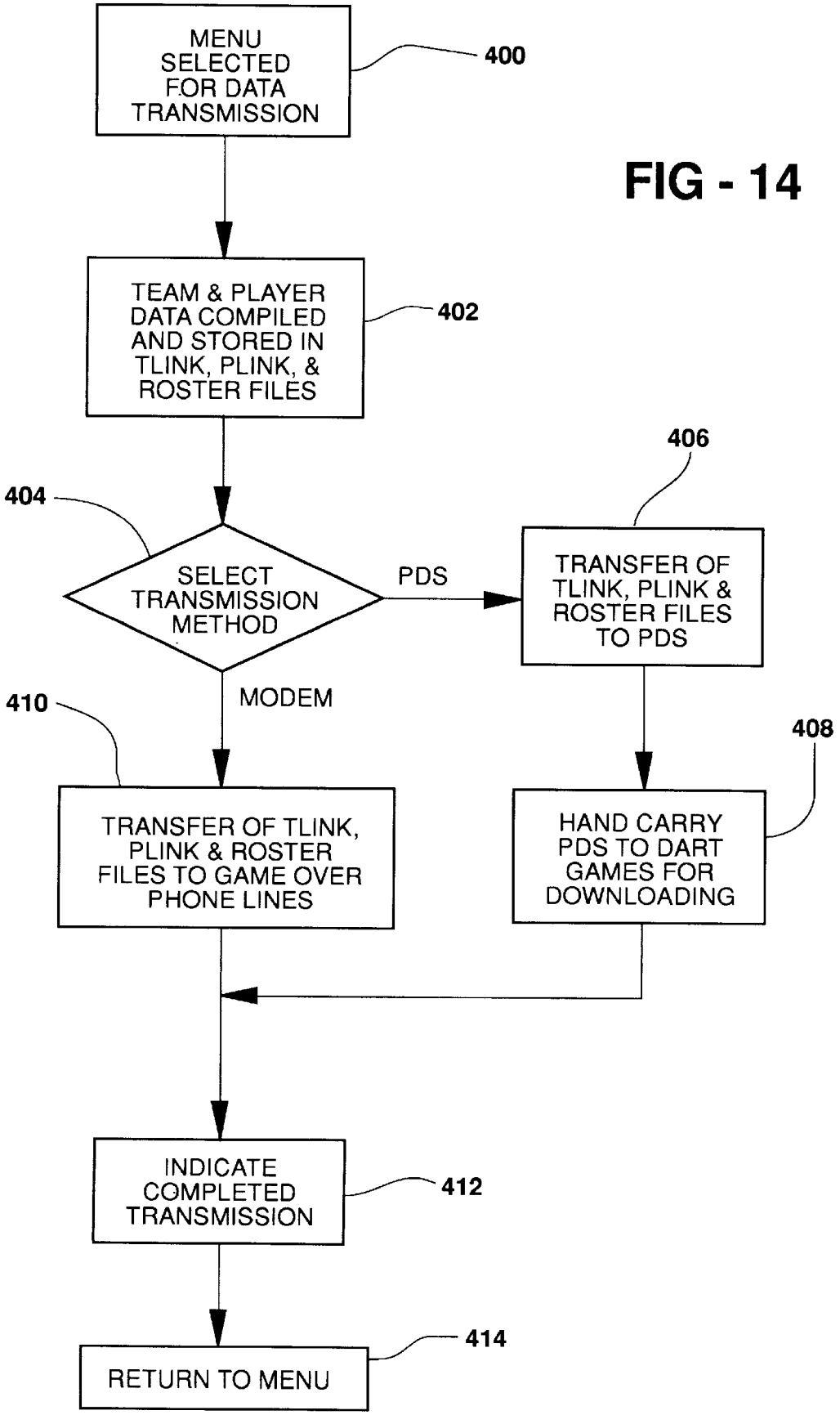
FIG. 14 is a flow chart depicting the program flow utilized by a league machine of the league and tournament system of FIG. 1 for transmitting league and/or tournament information to the electronic dart machines within the league and tournament system.

Referring now to FIG. 14, the routine utilized by league machine 12 to send data to dart machine 14 will be described. Entrance into the data transmission routine is achieved via a menu selection, as indicated at block 400. This menu selection can be one of a plurality of menu options, others being for such purposes as: adding new leagues or teams or manually adding player names and other player information; scheduling matches for a league; and accessing information from one or more of the dart machines 14. Once the data transmission routine has been selected, the league database information, including team and player data, is compiled and stored in team link (TLINK), player link (PLINK), and roster files, each having a specific format that will be described below. This is indicated by block 402. Next, at block 404, the method of transmission is chosen by the operator. The operator can choose to have the files transmitted to each of the dart machines 14 using the same communication path, or can transmit to some (e.g., located within the same city) via PDS 22 and others (e.g., located in other cities) via modem.

If PDS communication is chosen, then the team link, player link, and roster files are transmitted to PDS 22 by way of IR module 26, as indicated at block 406. Transmission to PDS 22 can be accomplished by configuring PDS 22 into a pc link mode and then entering a command into league machine 12 to initiate the data transmission. PDS 22 is then carried to the one or more dart machines 14 for which communication is desired and the files are transmitted by PDS 22 and received via IR link 24 on dart machine 14, as indicated by block 408. Transmission of the data to dart machine 14 can be accomplished in any suitable manner, such as by putting dart machine 14 into a receive mode using a barcoded card or a menu selection from monitor 44 using select switch 50, putting PDS 22 into pc link mode, and thereafter having dart machine 14 initiate transmission.

If, at block 404 modem communication was selected, then as indicated at block 410, the team link, player link, and roster files are transferred to dart machine 14 via the phone lines. This modem communication can be done using ZMODEM. Regardless of whether the files are transferred to dart machine 14 by modem or to PDS 22 via IR module 26, a completion indication is provided to the operator once transmission is complete. This is shown at block 412. Thereafter, flow returns to the menu screen, as indicated at block 414.

Figure 15:
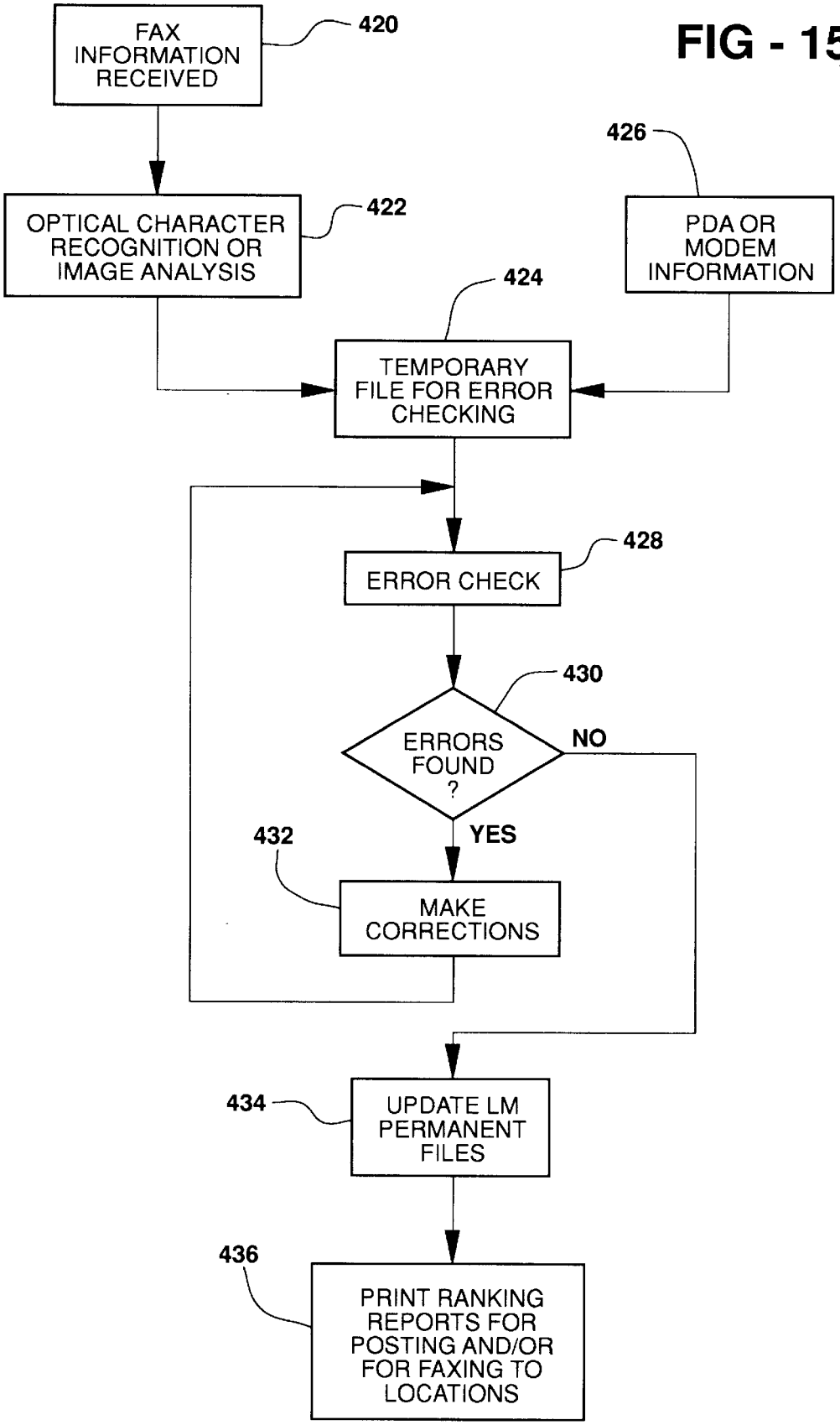
FIG. 15 is a flow chart depicting the program flow utilized by the league machine for receiving and utilizing data sent from one of the electronic dart machines within the league and tournament system.

As mentioned above, transmission from electronic dart machine 14 to league machine 12 can be by way of modem, facsimile, or PDS communication. Regardless of the transmission medium, the data is formatted into a match results file that will be described below. The routine used by league machine 12 for receiving and utilizing data from dart machines 14 is depicted in FIG. 15. For facsimile transmission, the facsimile is initially written into a file on the league machine's hard drive, as indicated at block 420. Then, either the optical character recognition or image analysis program is run, depending upon whether the facsimile is to be converted into an ASCII file by character recognition or by decoding glyphs. This is shown at block 422. The resulting ASCII data is stored in a temporary file, as indicated at block 424, so that an error checking routine can be run that checks to see whether the data is reasonable and the file formats are correct. For modem or PDS transmission, no image processing is necessary and the data is put directly into the temporary file, as indicated at block 426.

Once the temporary file has been created, the error checking routine is begun. First, a check for errors is made, as indicated at block 428. Program flow then moves to block 430 and, if one or more errors are detected, flow moves to block 432 where corrections are made in an attempt to eliminate the error. Then, flow returns to block 428 to again check for errors. This loop is repeated until the detected errors are eliminated or it is determined that they cannot be corrected, necessitating a retransmission of the data. If, at block 430, it is determined that no errors exist, then flow moves to block 434 and the permanent league database files of player and team information are updated. This can include determining updated player handicaps that will be utilized in the next match. Thereafter, ranking reports can be generated and sent to the remote locations for posting, as indicated at block 436.

Figure 16:
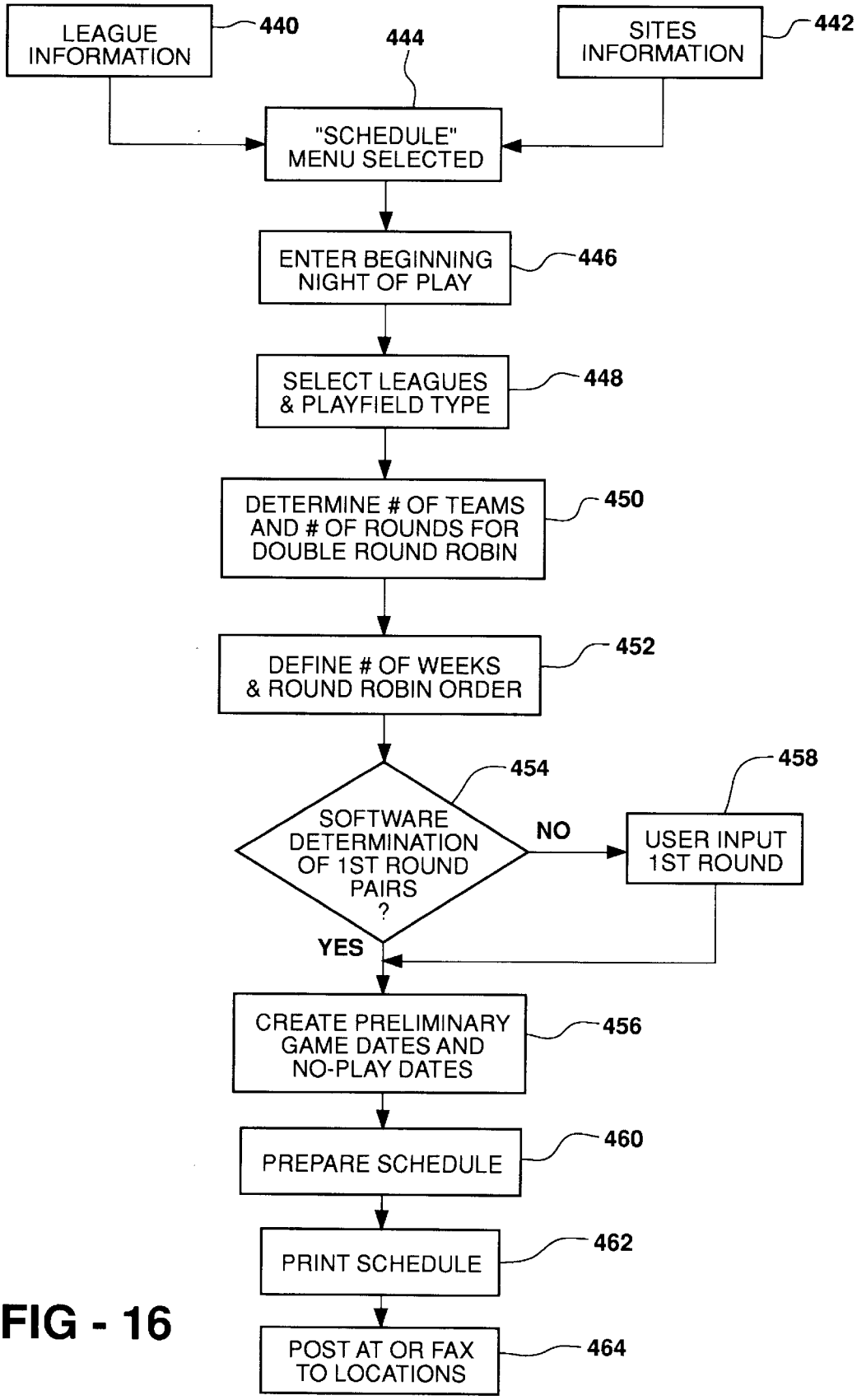
FIG. 16 is a flow chart depicting the program flow utilized by the league machine for generating a league schedule.

Referring next to FIG. 16, the routine used by league machine 12 to schedule the league games will be described. Initially, basic league and site information is put into the league database, as indicated at blocks 440 and 442. League information includes the game(s) to be played within the league, the player rotation order, and the teams within the league. Site information includes the locations where the games are to be played, the types of games at the sites (e.g., dart machines, pool tables), and the number of each type of game located at that site. Then, at block 444 the league scheduling routine is chosen via a menu selection, as described above in connection with entering the data transmission routine. Flow then moves to block 446 where the operator is requested to enter the beginning night of game play for the league or leagues. Then the operator is asked to select from a list of all of the unscheduled leagues those leagues for which a schedule is to be generated, as indicated at block 448. At the same time the operator is asked to select the playfield type; that is, what type of game (e.g., darts, pool) the league will be playing.

Then, at block 450, for each league to be scheduled, league machine 12 determines the number of teams in that league and the number of rounds to be played in the case of a double round robin league. The operator is then requested to input the number of weeks and to select whether the round robin order for the second half of the league games is to be the same or opposite the first half of the games, as indicated at block 452. Then, at block 454 league machine 12 queries the operator as to whether the first round pairs should be automatically determined by league machine 12. If so, this is done and program flow moves to block 456. If not, the operator is requested to select first round pairings, as indicated at block 458 and flow thereafter moves to block 456. At block 456, league machine 12 creates preliminary game dates and no-play dates, as in the case of a holiday. If the game and no-play dates are approved by the operator, then the schedule is prepared, as indicated at block 462 and is sent to the remote locations, such as by facsimile transmission for posting. This is indicated at block 464. Although, basic team information (such as the number of teams in the league) is necessary to generate the start league play and to generate the schedule, it will be appreciated that the individual teams do not have to be organized at that time. Information such as team names and the names of the players on the teams can be added to the database via the dart machines 12 just prior to play of the first round of league play.

Menu Screens

Figure 17:
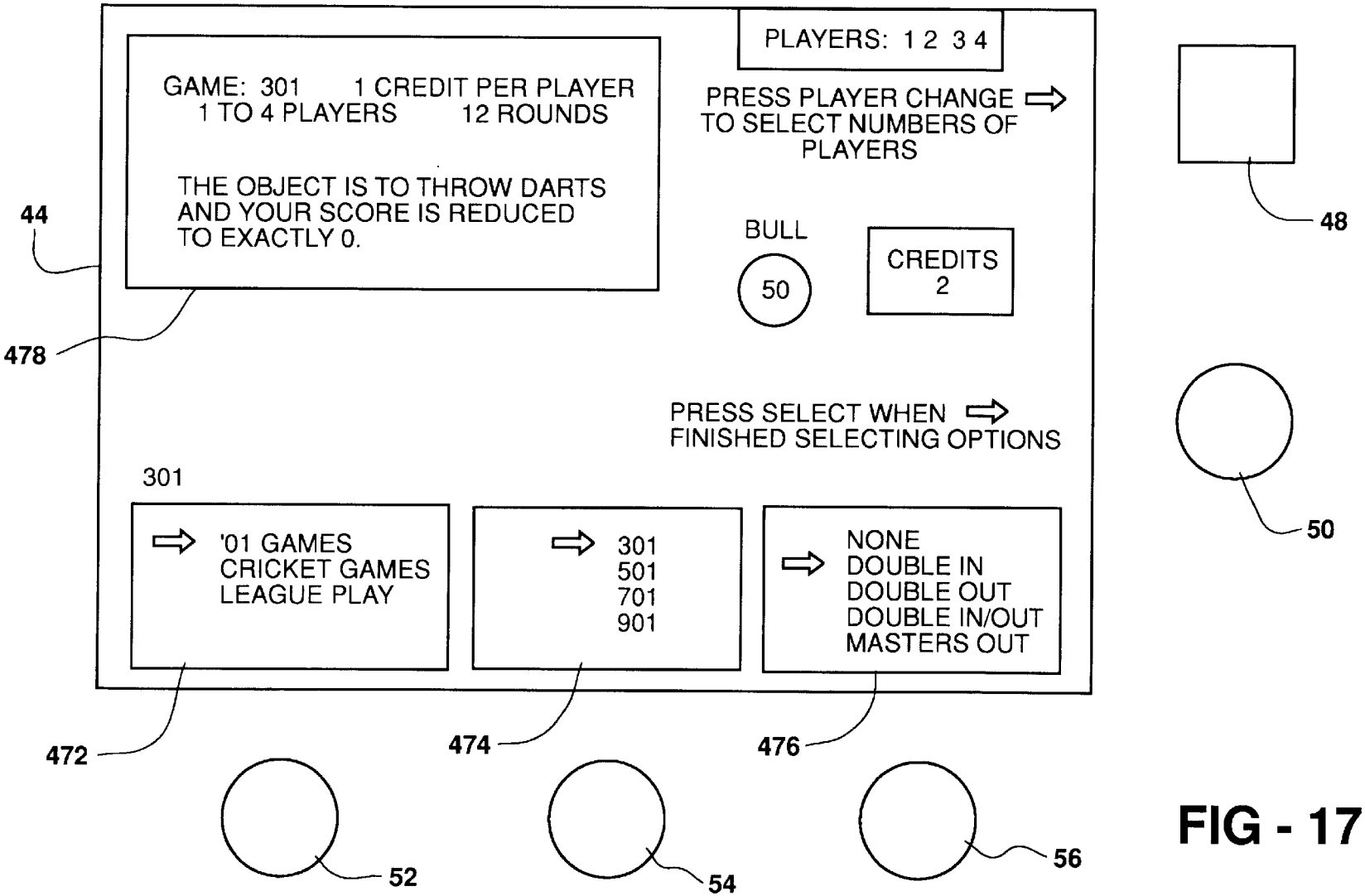
FIGS. 17 and 18 show exemplary views of the user interface of the dart machine of FIG. 2.
Figure 18:
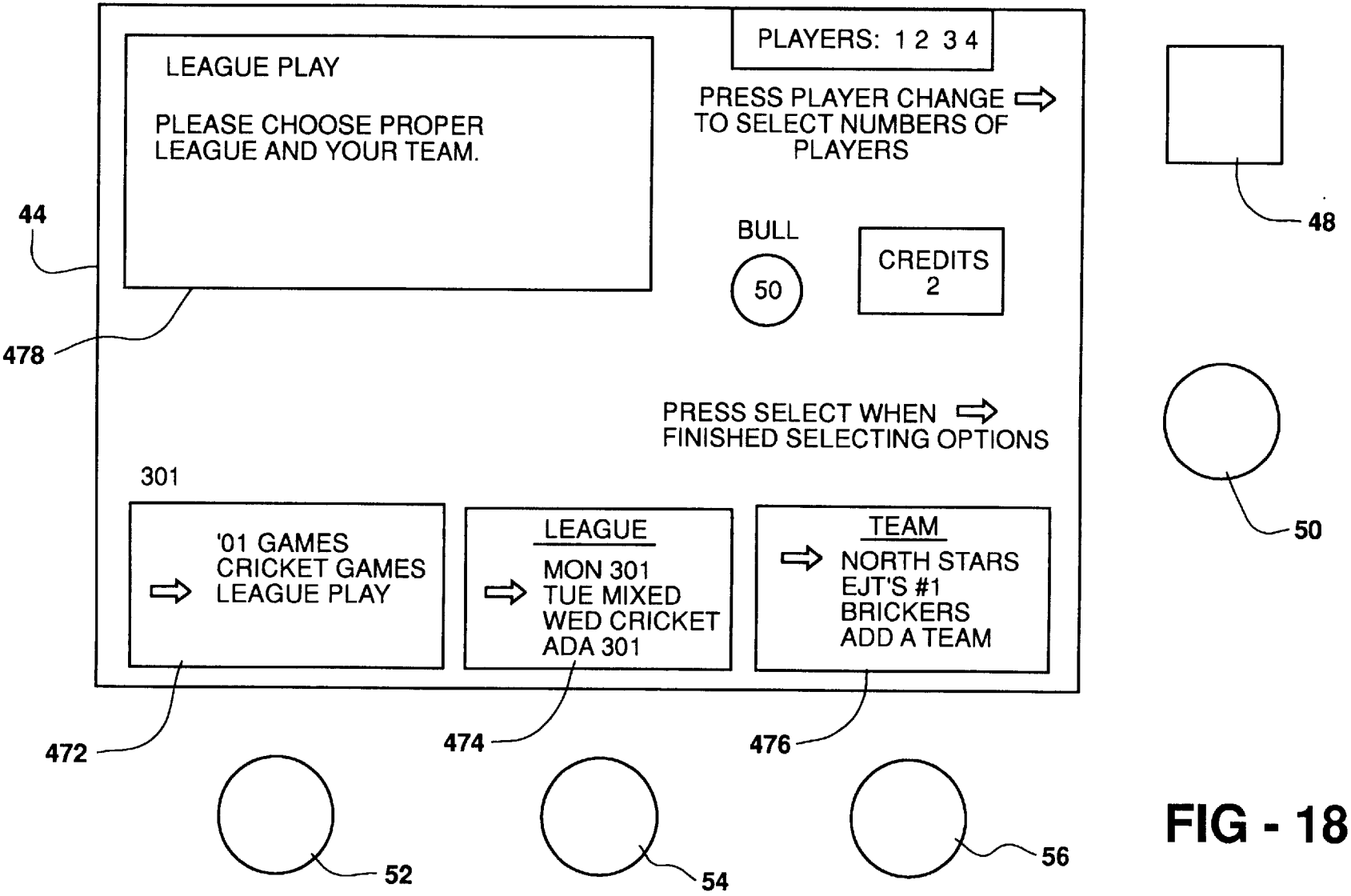

Dart machine 14 utilizes monitor 44 to provide a set of menu screens that permits a player to make game and league selections and input handicap and other player information in a simple and intuitive way. With reference to FIGS. 17 and 18, this is accomplished using three menu screens 472, 474, and 476 that are located along the bottom one-third of monitor 44 adjacent the three menu switches 52, 54, and 56, respectively. These three screens are used to simultaneously display different levels of the overall menu hierarchy. An example of this hierarchy for '01 Games and League Play can be seen in FIG. 19. At the top level of the menu hierarchy are selections between 01' Games, Cricket Games, and League Play. If '01 Games is selected, then the player can then choose among four different types of '01 games: 301, 501, 701, and 901. Regardless of the '01 game chosen, the player can also specify certain game options, such as Double IN, Double OUT, Double IN/OUT, or Masters OUT. For League Play, the participant must choose between the different leagues that use the dart machine. Then, the participant must select that player's team from among a list of teams that is unique to the chosen league. Also displayed on monitor 44 is a miscellaneous screen 478 that can be used for various purposes, including providing context-sensitive information and/or instructions.

Figure 19:
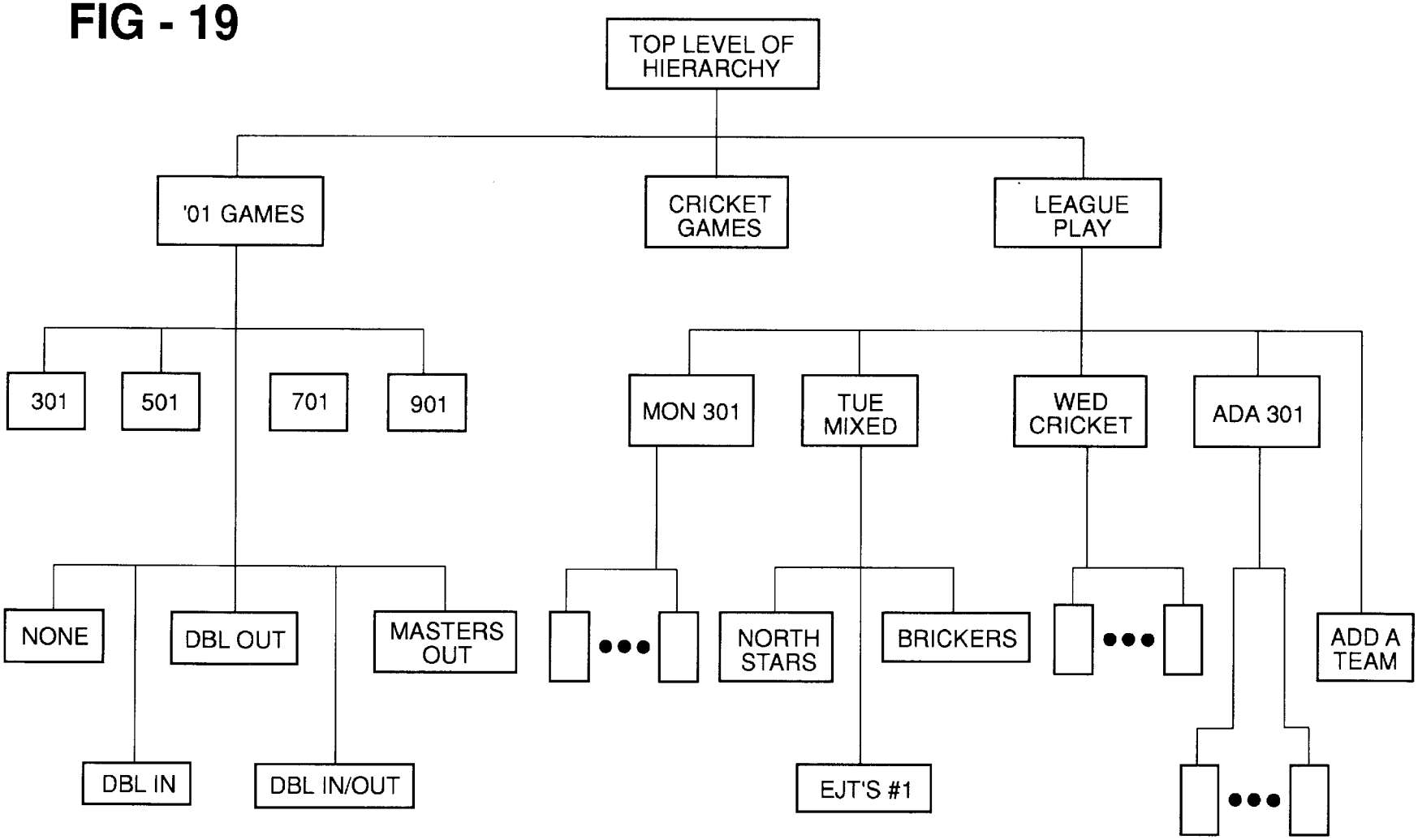
FIG. 19 is a diagrammatic view of an exemplary menu hierarchy used for the user interface of the dart machine of FIG. 2.

As will be appreciated by a comparison of FIG. 19 with FIGS. 17 and 18, these levels of menu hierarchy are displayed simultaneously and in a context-sensitive manner using menu 1 (menu screen 472), menu 2 (menu screen 474), and menu 3 (menu screen 476). This enables a player to see at any one instant the path that has been selected through the different levels of the hierarchial menu structure. The player can move within each level (i.e., within each of the three menu screens) using the menu button 52, 54, or 56 associated with that level (menu screen), with an arrow within the menu indicating the menu item chosen within that level (menu). Furthermore, movement within a single level that alters the contents of the options at lower levels in the hierarchy automatically results in the menu screen(s) associated with the lower level(s) being updated to reflect the options at that level. An example of this context-sensitive menuing can be seen by comparison of FIGS. 17 and 18. In FIG. 17, '01 Games has been chosen, resulting in menu 2 displaying the various types of '01 games available and menu 3 indicating game play options. Then, if League Play is chosen using menu button 52, menu 2 and menu 3 change to that shown in FIG. 18.

Buttons 52–56 permit a player to move through the menu items within the three menu screens. To enter the selection of the chosen menu items, select button 50 is used. As will be appreciated, the hierarchial menu structure can have more than three levels so that making of selection of menu items using select button 50 may result in the display of a further set of menu screens representing lower levels in the hierarchy.

Figure 20:
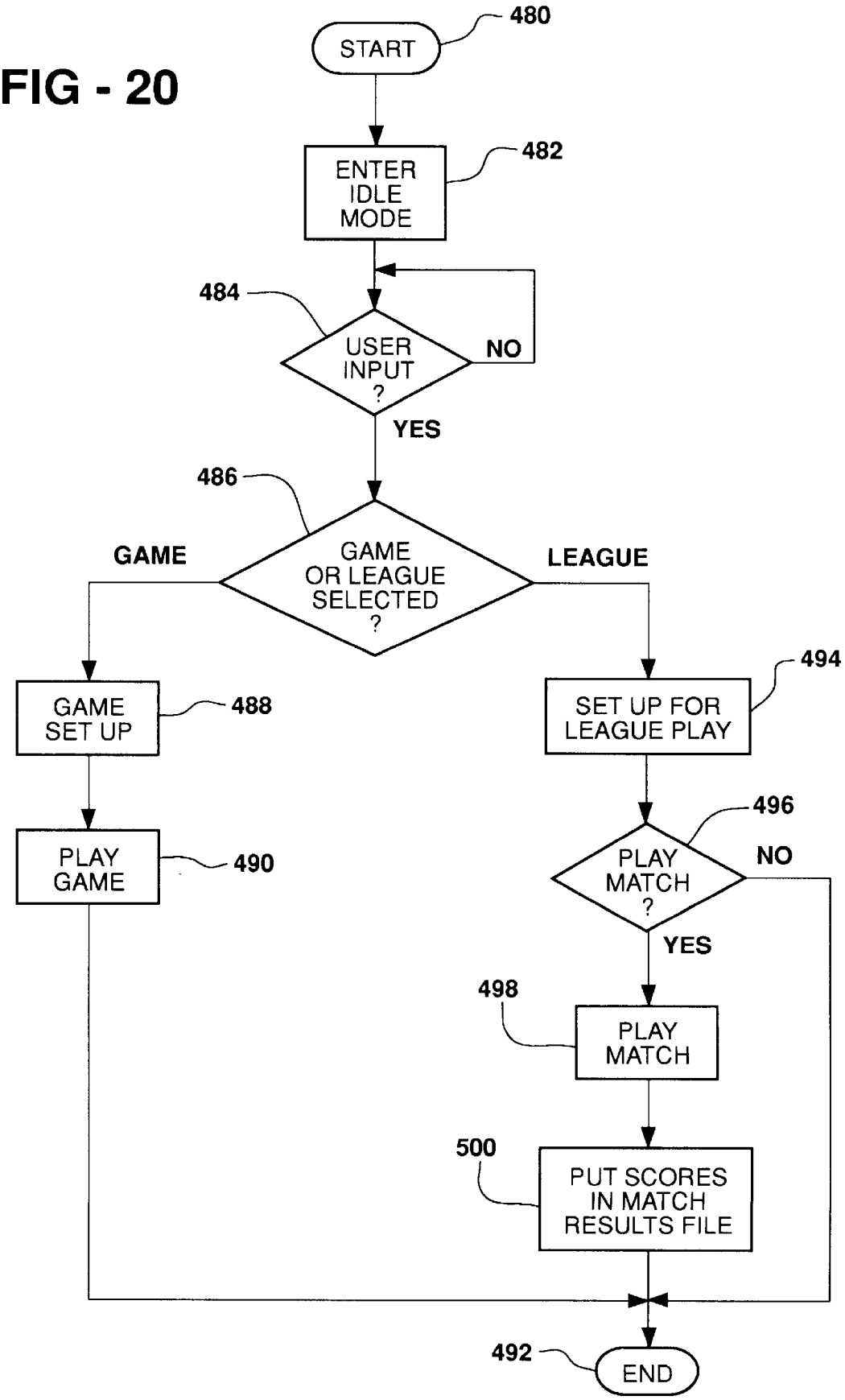
FIG. 20 is a flow chart that provides an overview of the program flow of the dart machine of FIG. 2.
Figure 21:
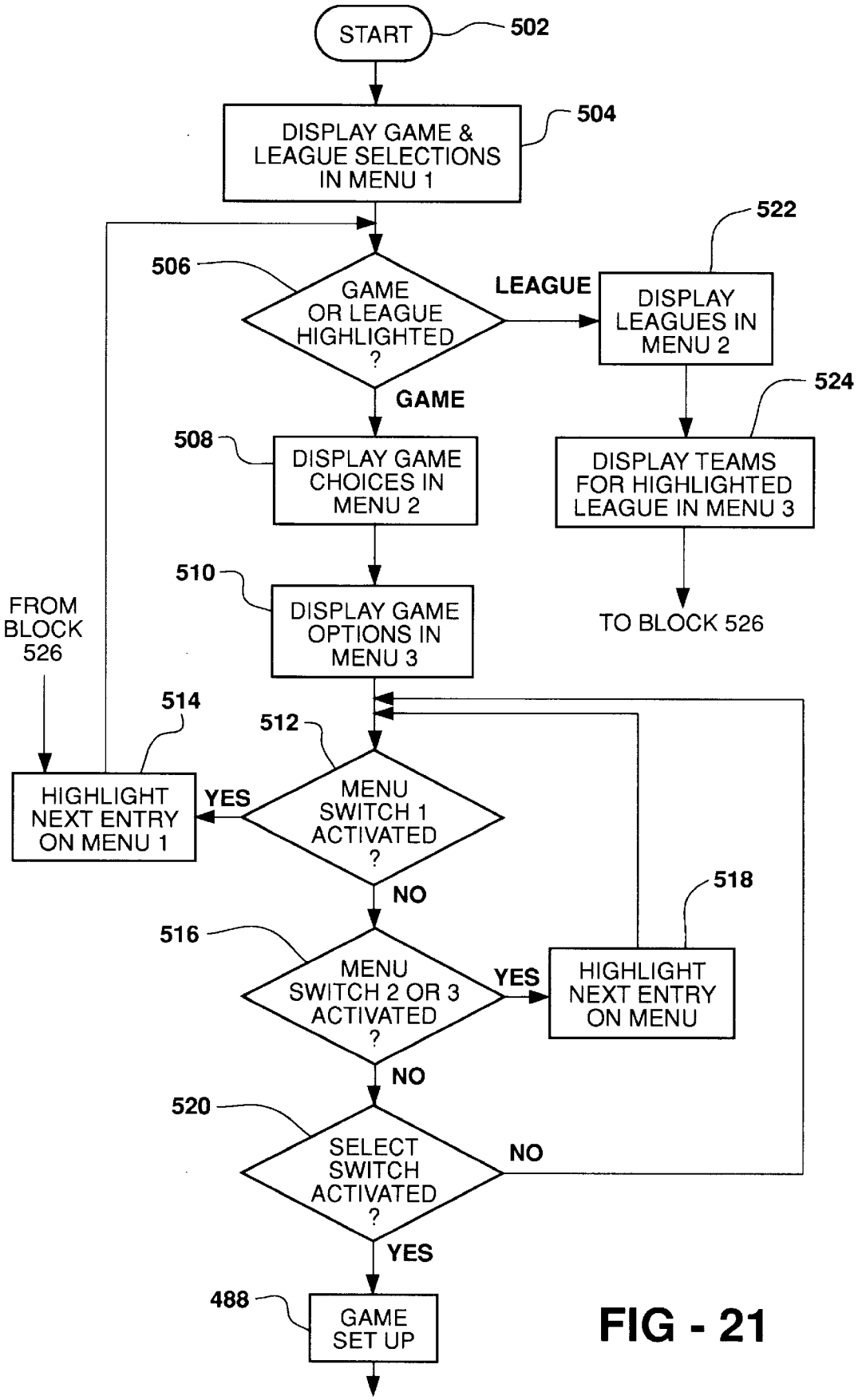
FIGS. 21–24 are flow charts depicting program flow for the user interface of the dart machine of FIG. 2.
Figure 22:
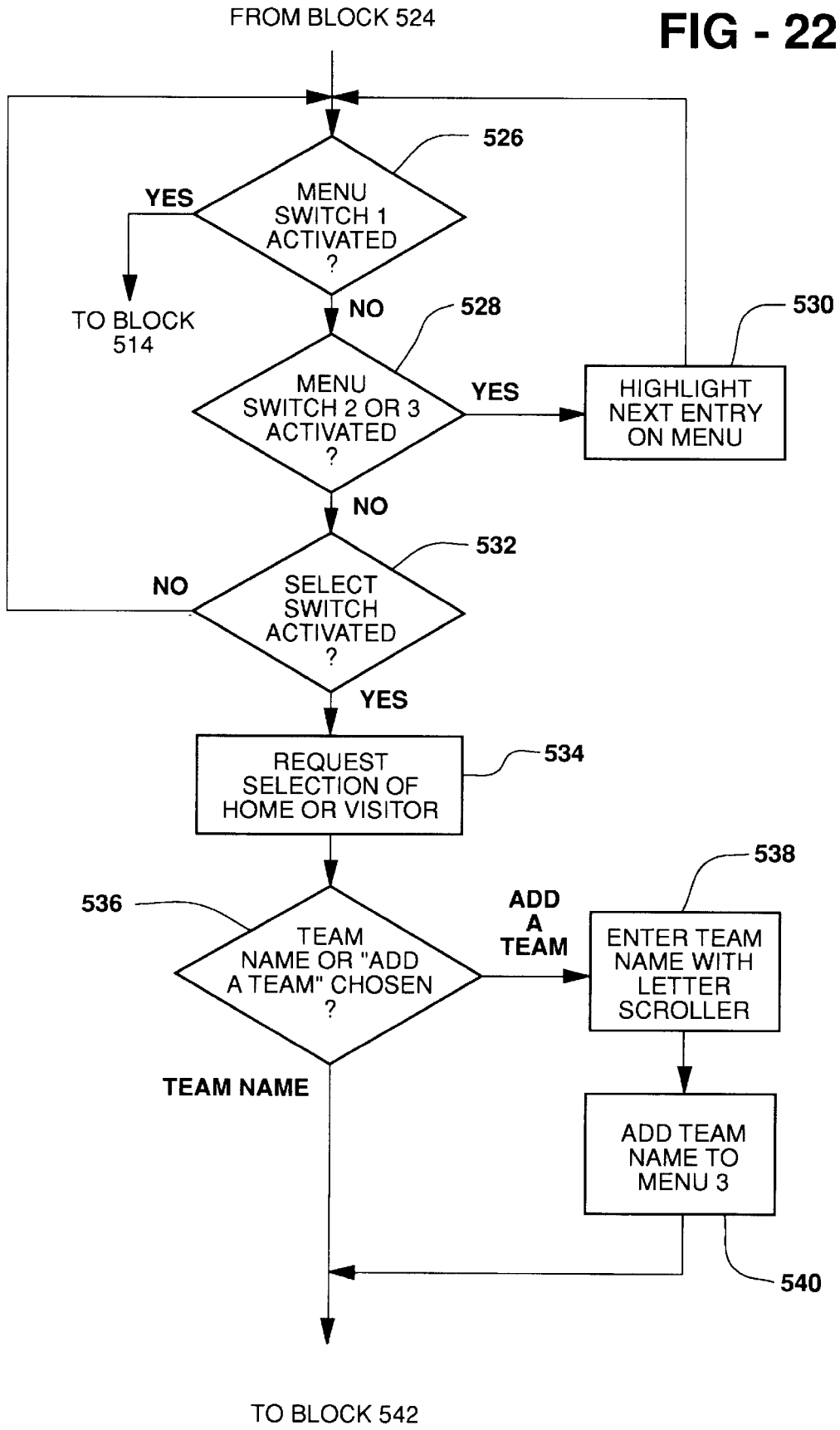

Referring now to FIG. 20, an overview of the operation of electronic dart machine 14 is shown. From start block 480 program flow moves to block 482 where dart machine 14 is placed in an idle mode, awaiting to be played. This idle mode can include placing IR body sensor 124 in the attract mode, as described above. Flow then moves to block 484 where dart machine 14 waits for user input, whether by depositing coins, making menu selections, or otherwise. Once user input is detected, flow moves to block 486 where dart machine 14 determines whether the player has selected to play a regular or league game. If a regular game has been selected, flow moves to block 488 for game set up, including selecting game options and inserting handicaps, if any. Thereafter, the game program is run and the game played, as indicated at block 490. Flow then moves to end block 492. If, at block 486, league play was selected, then flow moves to block 494 where the participant must input various information to associate that player with a league and team. As discussed above, this information can be input either through menu selections or by using a barcoded player card, such as shown in FIG. 6. Then, at block 496 if the participant indicates that a match is to be played, flow moves to block 498 where dart machine 14 executes the game routines so that the match can be played. After the match games have been played, the score results are placed into the match results file, which will be described below. If, at block 496 the participant does not select to play a league game, such as in the case where the participant is registering only, then flow moves to end block 492. Turning now to FIGS. 21 to 24, the program flow for implementing blocks 486 and 494 of FIG. 21 using menus 1, 2, and 3 will now be described. Initially, flow moves from a start block 502 to block 504 where the game and league menu items are displayed in menu 1. This can be seen by reference to FIGS. 17 and 18. Then, at block 506 if a game menu item (e.g., '01 Games or Cricket Games) has been highlighted (i.e., chosen) using menu button 52, then flow moves to block 508 where the game choices for the highlighted item from menu 1 are displayed in menu 2. This is shown in FIG. 17. Then, at block 510, the game options are displayed in menu 3, which is also shown in FIG. 17. Program flow then moves to block 512 and if menu switch 1 (menu button 52) has been activated then the next menu item in menu 1 is highlighted (e.g., using the arrows shown in FIG. 17), as indicated at block 514. Flow then returns to block 506 to determine whether the newly highlighted item in menu 1 is a game or league menu item. If at block 512, menu switch 1 is not activated, then flow moves to block 516 where it is determined whether either menu switch 2 (menu button 54) or menu switch 3 (menu button 56) have been activated. If so, flow moves to block 518 where the next item on the menu associated with the activated switch is highlighted. Flow then returns to block 512 to check for further menu switch activations. If none of the menu switches have been activated then flow moves to block 520 where it is determined whether the select switch (select button 50) has been activated. If not, flow loops back to block 512 and will continue to loop through these blocks until the select switch is activated to enter a set of menu selections. If at block 520 the select switch has been activated, then program flow moves to block 488, which is the same place in the overall program loop that is shown in FIG. 20.

If at block 506, the League Play item in menu 1 is highlighted, then flow moves to block 522 where the league names are displayed in menu 2 and then to block 524 where the team names for the highlighted league are displayed in menu 3. These menu screens are shown in FIG. 18. Flow then moves to block 526 of FIG. 22 where a check is made to see if menu switch 1 has been activated. If so, flow moves to block 514 of FIG. 21 and then back to block 506. If not, flow moves to block 528 where a check is made to determine whether either menu switch 2 or 3 have been activated. If so, flow moves to block 530 where the next item on the menu associated with the activated switch is highlighted. Flow then returns to block 526 to check for further menu switch activations. If none of the menu switches have been activated then flow moves to block 532 where it is determined whether the select switch has been activated. If not, flow loops back to block 526. If at block 532 the select switch has been activated, then program flow moves to block 534 where a screen is displayed to request that the participant indicate whether that participant is on the home or visiting team, with the menu switch 1 being used to choose visitor, menu switch 3 being used to choose home, and the select switch being used to enter the participant's choice. Flow then moves to block 536 where it is checked whether the item in menu 3 that was selected upon activation of the select switch at block 532 was the "Add a Team" option. If so, a letter scroller screen is displayed requesting that the new team name be added, as indicated at block 538. Selection of letters for entering the team name can be accomplished using menu switches 1 and 3 to move through the alphabet in opposite directions. Menu switch 2 can be used to add a letter to the team name and once the name is complete, the select switch can be activated to enter the new team name into dart machine 14. Flow then moves to block 540 where the new team name is added to the list of teams for the selected league. Flow then moves to block 542 of FIG. 23. Flow also moves from block 536 to block 542 if when the select switch was activated at block 532 a team was highlighted in menu 3 rather than the "Add a Team" option.

Figure 23:
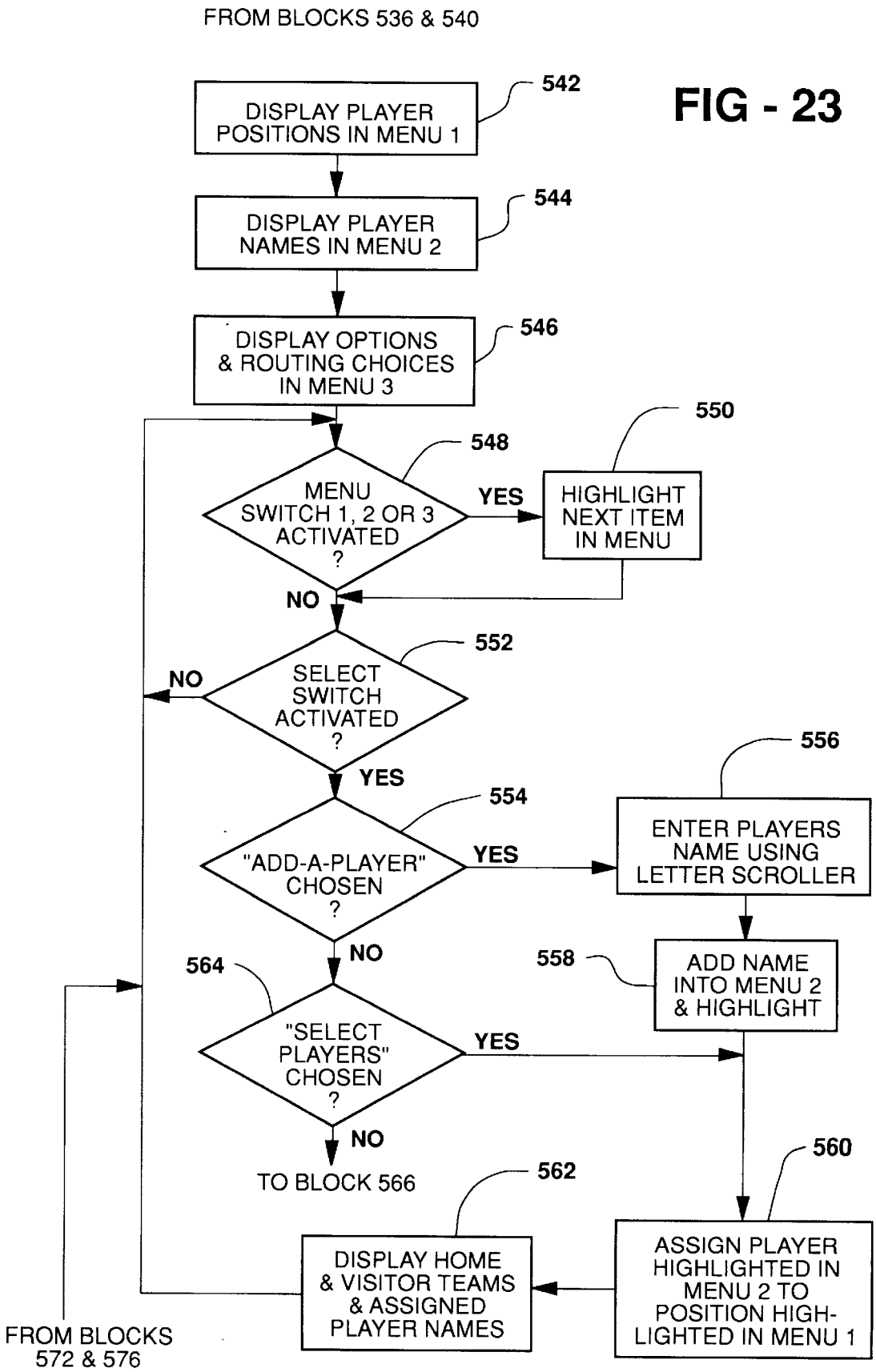

FIG. 23 depicts program flow once the participant has selected a team. Player positions (e.g., 1st, 2nd, 3rd, and 4th) are displayed as menu items in menu 1, as indicated at block 542. These player positions are for the team (home or visitor) that was selected at block 534 of FIG. 22. Player names for the selected team are displayed in menu 2, as indicated at block 544. Other display options (such switching to the player positions and player list for the other team), menu items (such as Add a Player), and routing choices (such as returning to the upper level menu screens) are displayed in menu 3, as indicated at block 546. Thereafter, flow loops through blocks 548, 550, and 552 until the select switch is activated, at which point program flow moves to block 554 where it is determined whether the "Add a Player" item from menu three was selected. If so, flow moves to block 556 where the new player's name is added using the same letter scroller screen described above for entering a new team name. After this is done, the three menu screens are restored and flow then moves to block 558 where the new player name is added to the list of players in menu 2 and is automatically highlighted. Flow then moves to block 560 where the new player name is assigned to the player position highlighted in menu 1. Then, the player position assignments for both the home and visiting team are displayed in the miscellaneous screen 478, as indicated at block 562. Flow then returns to block 548 to permit further assignments of players to team positions and adding of any other new players. If, at block 554, the "Add a Player" item from menu 3 had not been highlighted when the select switch was activated, then flow moves to block 564 where it is determined if the "Select Players" item from menu 3 was chosen. If so, the flow moves to blocks 560 and 562 to assign the player highlighted in menu 2 to the player position highlighted in menu 1 and then display the updated home and visitor player assignments. Thereafter, flow again loops back to block 548. If not, program flow moves to block 566 of FIG. 24.

Figure 24:
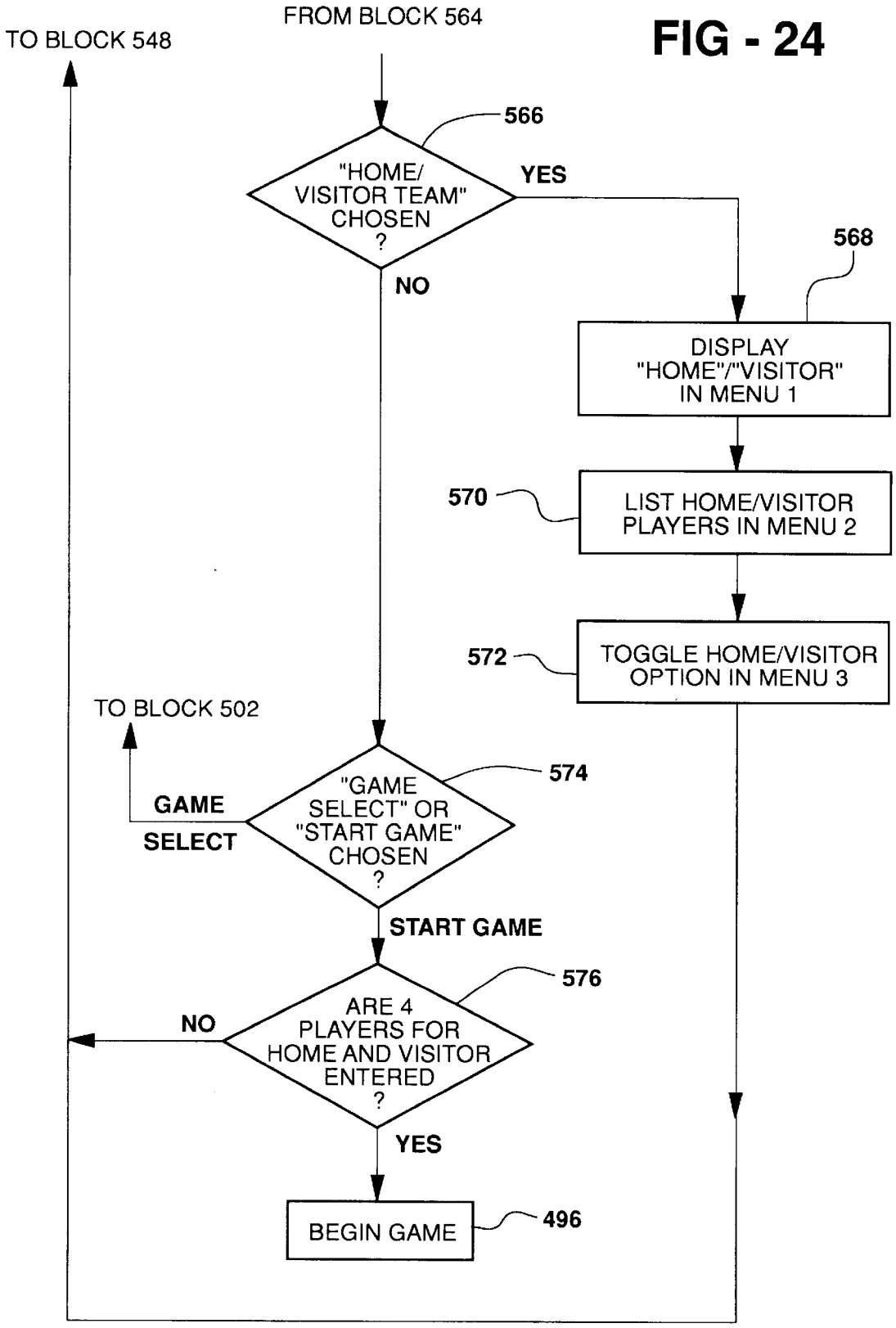

FIG. 24 is a continuation of FIG. 23. If neither "Add a Player" nor "Select Players" were selected from menu 3, then flow moves to block 566 to check whether a home/visitor item from menu 3 was selected. The home/visitor menu item permits switching between entering player selections for the home team and entering player selections for the visiting team. When home team players are being assigned for playing a match, this item appears in menu 3 as "Visitor" and when the player selections are for the visiting team, this item appears as "Home". If this menu item was selected using the select switch, then flow moves to block 568 where menu 1 is changed to indicate that the player selections are now for the other team. The display of player position numbers (1st, 2nd, 3rd, 4th) in menu 1 is maintained, since each team will have the same number of player positions. Flow then moves to block 570 where menu 2 is changed to list the players from the other team. Then, the home/visitor item in menu 3 is toggled; that is, either from "Home" to "Visitor" or vice-a-versa. Flow then returns to block 548 for further menu selections. If at block 566 the home/visiting team item had not be selected, then flow moves to block 574 to determine which of the remaining two possible items from menu 3 were chosen. If "Game Select" was chosen, then flow returns to start block 502 since "Game Select" is akin to an exit menu command. Otherwise, the item selected in menu 3 must necessarily have been "Start Game," in which case flow moves to block 576 to determine whether a player has been assigned to each of the player positions for each team. If not, the "Game Start" selection is effectively ignored and flow returns to block 548. If so, then flow moves to block 496 to begin the first game of match play.

As mentioned above, handicapping can be automatically applied to the scoring and playing of games, both for league and casual game play. For league play, handicaps can be stored in the league database and used either to adjust the initial score, as in ADA rules, or to permit the throwing of only as many spot darts as are providing by the player's handicap. These handicaps can be applied automatically once the identity of the player is known by the dart machine, whether by use of a barcoded player card or via menu selections using monitor 44. For casual game play, handicaps can be entered as a part of the game set up.

Figure 25:
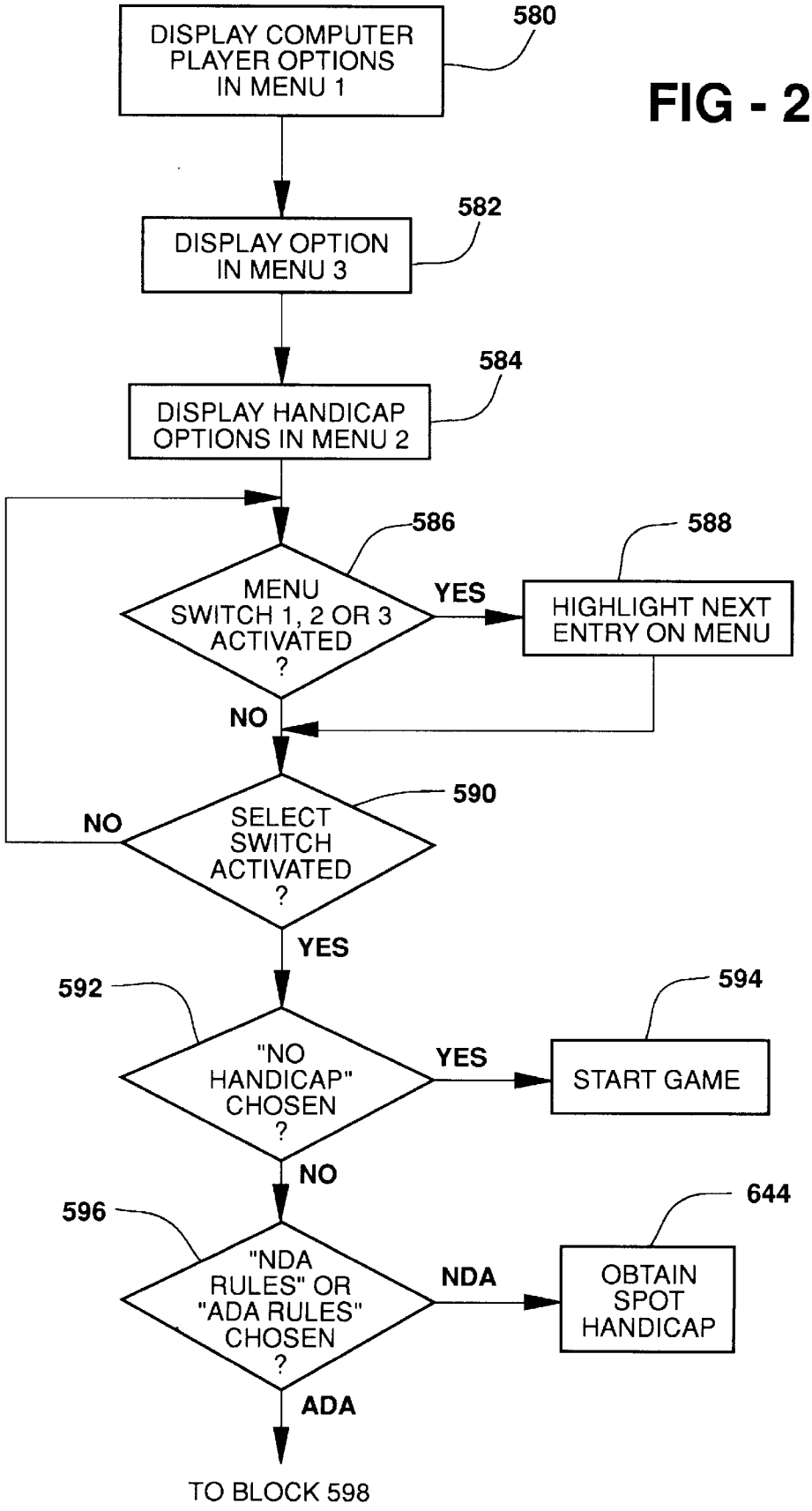
FIGS. 25–27 are flow charts depicting program flow for permitting manual entry of player handicaps.
Figure 26:
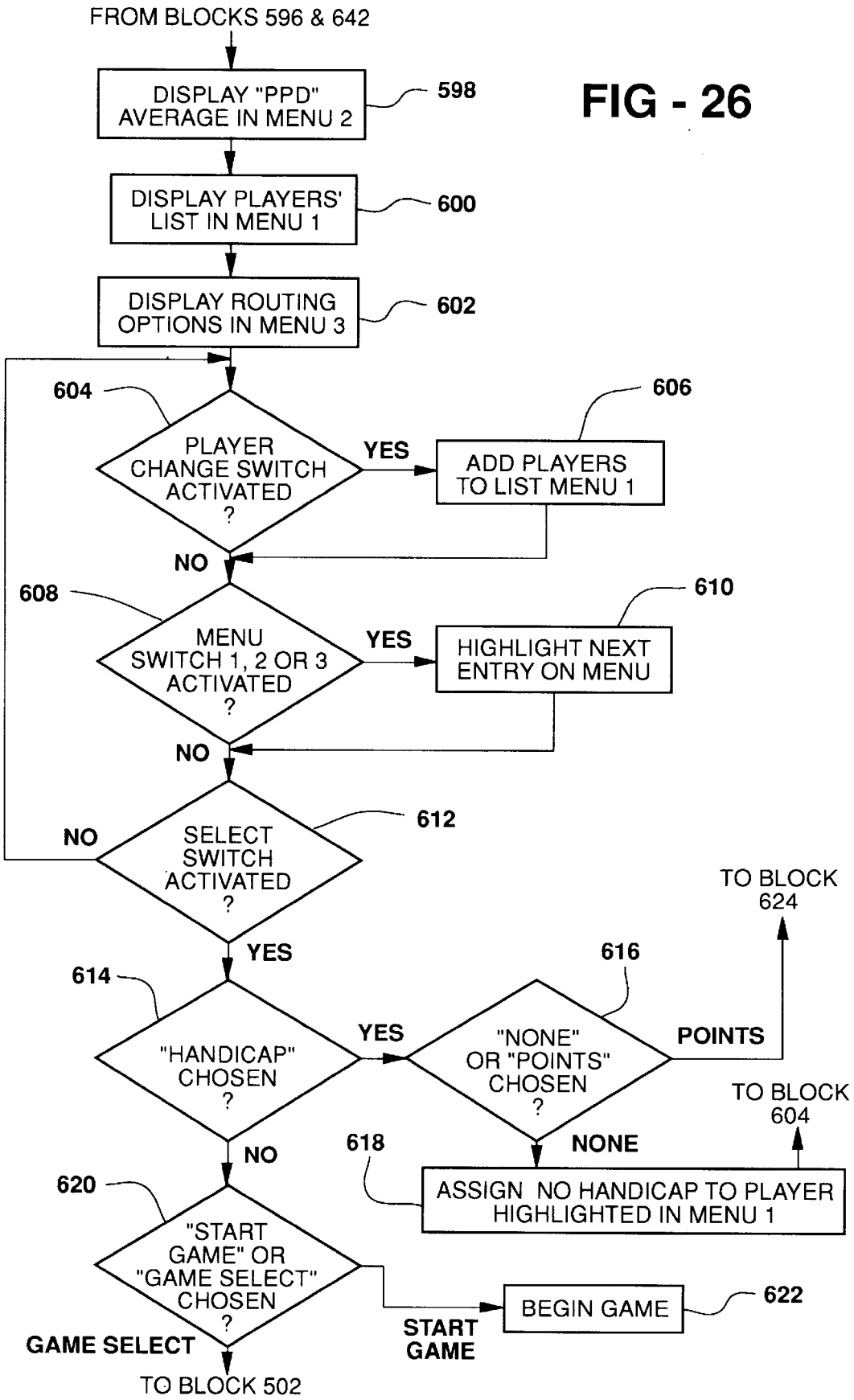
Figure 27:
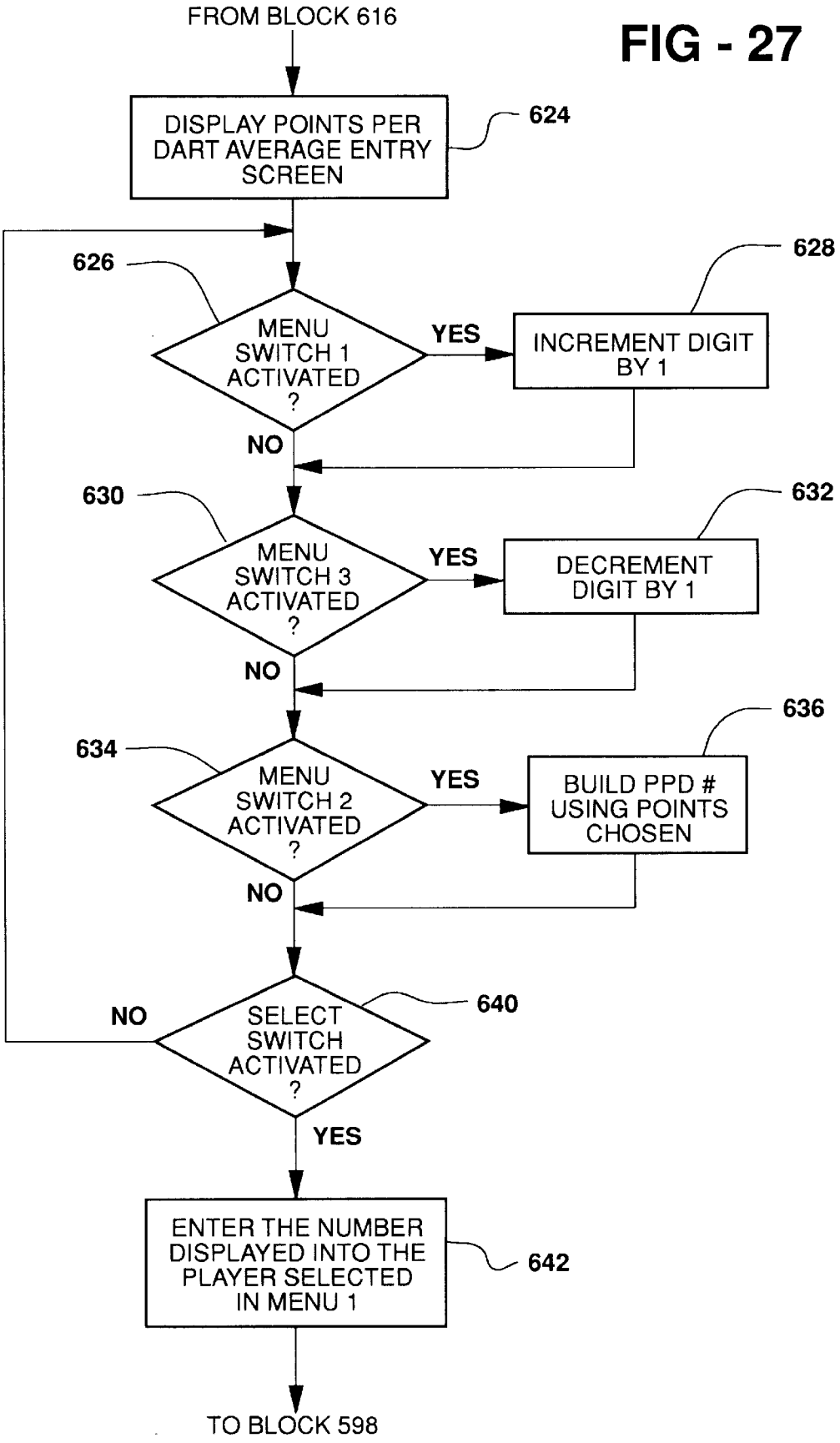

FIGS. 25–27 depict program flow for dart machine 14 for entering handicaps as a part of the game set up. Initially, menus 1, 2, and 3 are displayed as indicated at blocks 580, 582, and 584. Menu 1 includes options for competing against a fictitious computer player. Menu 2 displays handicap options, such as "No Handicap," "ADA Rules," and "NDA Rules." Menu 3 displays other options such as "Game Select" to permit a return to the first set of menus. Switch activation is then checked at blocks 586, 588, and 590 using the looping scheme previously described. Once the select switch is activated, flow moves to block 592 to determine if the "No Handicap" item in menu 2 was highlighted when the select switch was activated. If so, flow moves to block 594 to begin game play. If not, flow moves to block 596 to determine which of the two remaining items from menu 2 was selected. If "ADA Rules" were chosen, then flow moves to block 598 of FIG. 26. At blocks 598, 600, and 602, new menu screens are displayed and the list of players (e.g., "Player 1", "Player 2") are displayed in miscellaneous menu 478 along with their handicaps once they are entered. Menu 1 contains the list of players (up to four) that will be competing in the game. Menu 2 displays a points per dart (PPD) average menu screen that provides two menu items, one marked "None" for indicating that no handicapping is to be applied to a particular player, and "Points" which, when selected changes the screen display to a number scroller for entering the player's points per dart average. Menu 3 displays "Handicap" for entering the handicaps, as well as routing options such as have been previously described.

Figure 28:
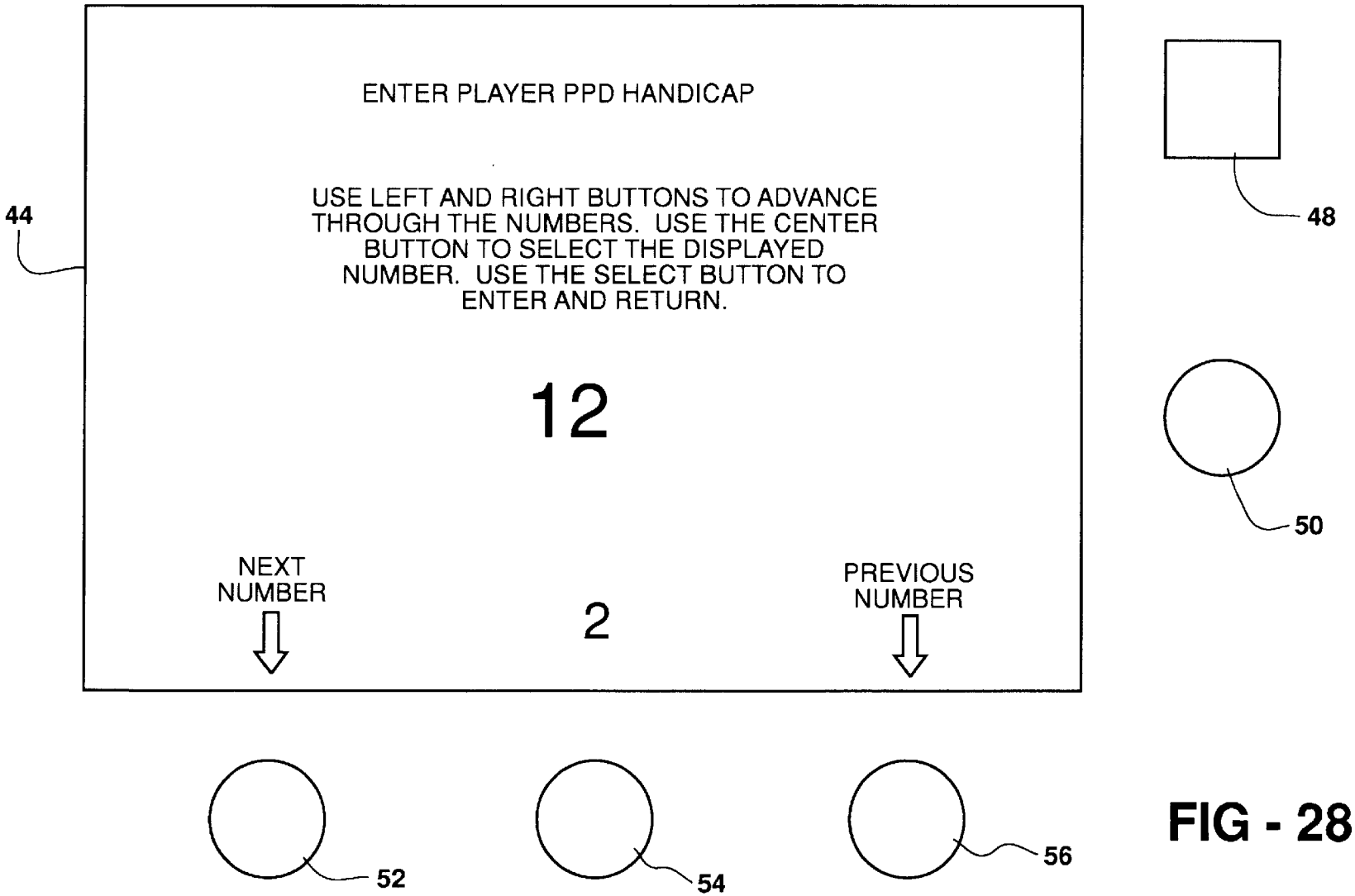
FIG. 28 shows a number scroller screen for manual entry of player handicaps.

Flow then moves to blocks 604, 606, 608, 610, and 612 which provide a switch activation test loop that is the same as previously described with the exception that it includes a check of whether player change switch 48 has been activated. If so, flow moves to block 606 to add a player (i.e., "Player 3") to the player list in menu 1. Once the select switch is activated, flow moves to block 614 where it is determined whether the "Handicap" item in menu 3 was selected. If so, then flow moves to block 616 where the item selected from menu 2 is checked. If "None" had been selected, then flow moves to block 618 and no handicap is assigned to the player that was selected using menu 1. This assignment of no handicap is indicated in miscellaneous menu 478 along with the other players' handicaps. Flow then returns to block 604 to permit entry of other players' handicaps. If at block 614 it was determined the "Handicap" was not chosen in menu 3, then flow moves to block 620 which determines which of the routing items from menu 3 was chosen. If "Start Game" was chosen then flow moves to block 622 to begin game play. If "Select Game" was chosen then flow returns to start block If at block 616, "Points" had been selected in menu 2, then flow moves to block 624 of FIG. 27 which displays a number scroller screen that is the same as the letter scroller described above, except that it is used for entering numbers rather than letters. FIG. 28 shows the screen display for the number scroller. After this screen is displayed flow moves to block 626 which checks whether menu switch 1 has been activated. If so, flow moves to block 628 which increments by one the digit displayed at the bottom center of the screen, directly above menu switch 2. Flow then moves from either block 626 or 628 to blocks 630 and 632 where menu switch 3 is checked and, if activated, causes the digit above menu switch 2 to be decremented by one. Flow then moves to block 634 where menu switch 2 is checked. If it has been activated, then the digit directly above it is appended onto the right side of the number displayed in the center of the screen, as indicated at block 636. In the example shown in FIG. 28, the numeral "1" was entered first using menu switch 2 and then the numeral "2" was entered, resulting in the number 12 being displayed in the center of the screen. Flow then moves to block 640 where a check of the select switch is made. If the select switch has not been activated, flow loops back to block 626. If it has, then at block 642 the number displayed in the center of the screen is assigned to the player that was selected from menu 1 in the previous set of screens. Flow then returns to block 598 to display and update the previous screens and to permit entry of additional handicaps. If at block 596, "NDA Rules" had been selected, flow would transfer to block 644 where the players would enter their spot handicaps using essentially the same process as shown in FIG. 26.

Once player handicaps have been entered, either manually at dart machine 14 or automatically via a communication path from league machine 12, the handicaps are applied by dart machine 14 to the player's starting scores. For ADA points per dart handicapping, this is done by adjusting the player's beginning score in accordance with their handicap. For NDA, this is done by permitting each player a certain number of scored throws prior to commencement of the first round of game play. Dart machine 14 permits each player to throw only as many spot darts as that player's handicap allows.

Transmitted File Formats

FIGS. 29–32 show the formats used for the records in the Roster, Team Link, and Player Link files which are used to transmit the league database information from league machine 12 to dart machine 14, and in the Match Results file which is used to transmit from dart machine 14 to league machine 12 game results, as well as player and team registration information that is entered at dart machine 14. Data within each field is enclosed in parenthesis and the fields within a record are comma delimited. FIG. 33 depicts the format for providing game setup data that is located in fields 7–16 of the Roster File. Examples of Roster file records are as follows:

P-457 VALLEY

EXAMPLES:

"R","1","","","","","","","","","","","","","","","","","","

Record Version Record. Record Version=1.

"S", "123","","","","","","","","","","","","","","","","","","

Security Code Record with security code of 123.

-continued

P-457 VALLEY

"I","456","","","","","","","","","","","","","","","","","","","","
Issuer ID Record with issuer ID of 456.
"L","2","West Side 301/501","","12","N",
"3DD413C4D,3DD411A2B,3DD411A4D,",
"3DD413C2B,3DD414B1C,3DD412D3A,",
"5AD411A3C,5AD412B4D,5AD414B3A,",
"5AD412D1C,5AD414C2A,5AD413D1B"
League Record. League ID=2; Name=West Side 301/501; Number of Games Played=12; Handicap Method=NDA; The first six games played are 301 Double In-Double Out (3D); The last six games played are 501 Any In-Any Out (5A); All games are played using the Double Bull with 4 Players, 1 Player per position (D41). Rotation is as in the following table:

| GAME | 1 | 2 | 3 | 4 | 5 | 6 | 7 | 8 | 9 | 10 | 11 | 12 |
|---|---|---|---|---|---|---|---|---|---|---|---|---|
| H1(1) | | 1 | 1 | | 3 | | 1 | | | 3 | | 3 |
| H2(2) | | 3 | | 3 | | 1 | | 1 | | 1 | 3 | |
| H3(3) | 1 | | | 1 | | 3 | 3 | | 3 | | | 1 |
| H4(4) | 3 | | 3 | | 1 | | | 3 | 1 | | 1 | |
| V1(A) | | 2 | 2 | | | 4 | 2 | | 4 | | 4 | |
| V2(B) | | 4 | | 4 | 2 | | | 2 | 2 | | | 4 |
| V3(C) | 2 | | | 2 | 4 | | 4 | | | 4 | 2 | |
| V4(D) | 4 | | 4 | | | 2 | | 4 | | 2 | | 2 |

"T","101","Sharpshooters","","","","","","","","","","","","","","","","","","
Team Record with Team ID of 101 and Name Sharpshooters.
"P", "2345", "Doe,John","DBoss","","","","","","","","","","","","","","","","
Player Record with Player ID of 2345, Name of John Doe, and nickname DBoss.
Examples of Team Link file records are as follows:
"1","2","","","","","","","","","","","","","","","","","","","","
Team 2 plays in League 1.
"99","678","","","","","","","","","","","","","","","","","","","","
Team 678 plays in League 99.
Examples of Player Link file records are as follows:
"1","2","3","31","33.92","","","","","","","","","","","","","","","","
Player 3 plays on Team 2 in League 1 with a 301 Handicap of 1 and a 301 Average of 3.92
"99","","1482","32","32.55","","","","","","","","","","","","","","","","
Player 1482 plays on no team (sub.) in League 99 with a 301 Handicap of 2 and a 301 Average of 2.55.
Examples of Match Results file records are as follows:
"R","1","","","","","","","","","","","","","","","","","","","","
Record Version record. Record Version=1.
"G","999","","","","","","","","","","","","","","","","","","","","
Game record. Game ID=999.
"M","123","99","080119942015","234","567","","","","","","","","","","","","","","
Match Record. Issuer ID=123; League=99; Match Date & Time=August 1, 1994 at 8:15 pm, Home Team ID=234, Visiting Team ID=567.
"P","234","1015","080119942015","A30,B31,C32,D33,E34,F35,G36,H37,",
"I38,J39,K350,L31365","","","","","","","","","","","","","","","","
Player Record. TeamID=234; Player ID=1015; Match Date & Time=August 1, 1994 at 8:15pm. All feats are 301 signified by the 3 in the second position of each feat value field. The lead characters in this example are defined as follows: A=6 Darts Outs, B=7 Dart Outs, C=8 Dart Outs, D=9 Dart Outs, E=4th Round Outs, F=Hat Tricks, G=High Tons, H=Low Tons, I=Wins, J=Total Games, K=Total Darts Thrown, L=Total Points Thrown.
Team ID=234; Player ID=1015; Player Scored 0 6-Dart-Outs, 1 7-Dart-Out, 2 8-Dart-Outs, 3 9-Dart-Outs, 4 4th-Round-Outs, 5 Hat-Tricks, 6 high-Tons, 7 Low-Tons, 8 Wins, 9 Total-Games, 50 Darts-Thrown and 1365 Points-Thrown.
"N","234","JDoe","080119942015","A30,B31,C32,D33,E34,F35,
G36,H37,","I38,J39,K350,L31365","","","","","","","","","","","","","","","
New Player Record. Same as above except name of new player appears in Player ID field.

Figure 34:
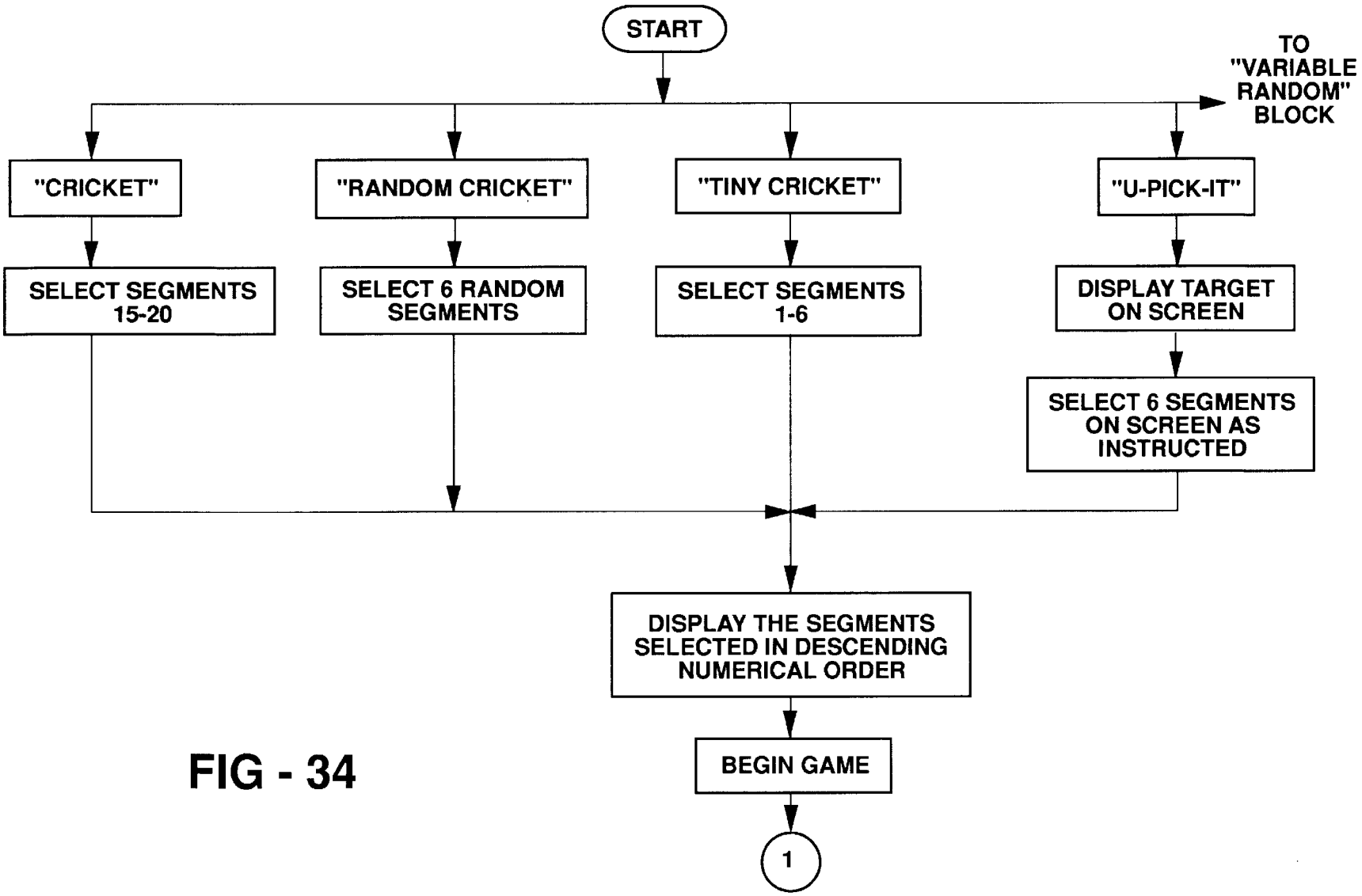
FIGS. 34–36 are flow charts depicting program flow for operating the variable cricket displays of the dart machine of FIG. 2.
Figure 35:
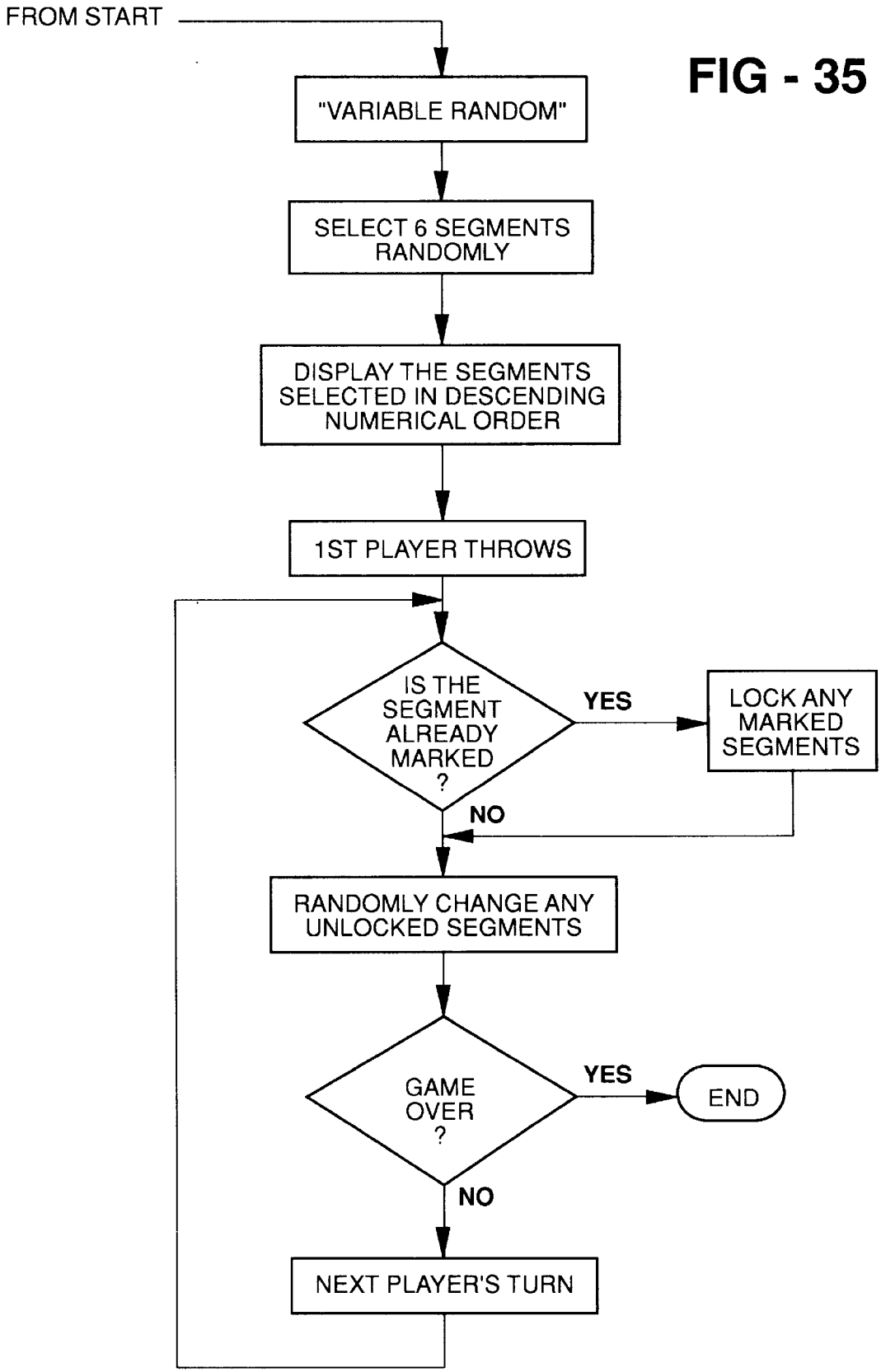
Figure 36:
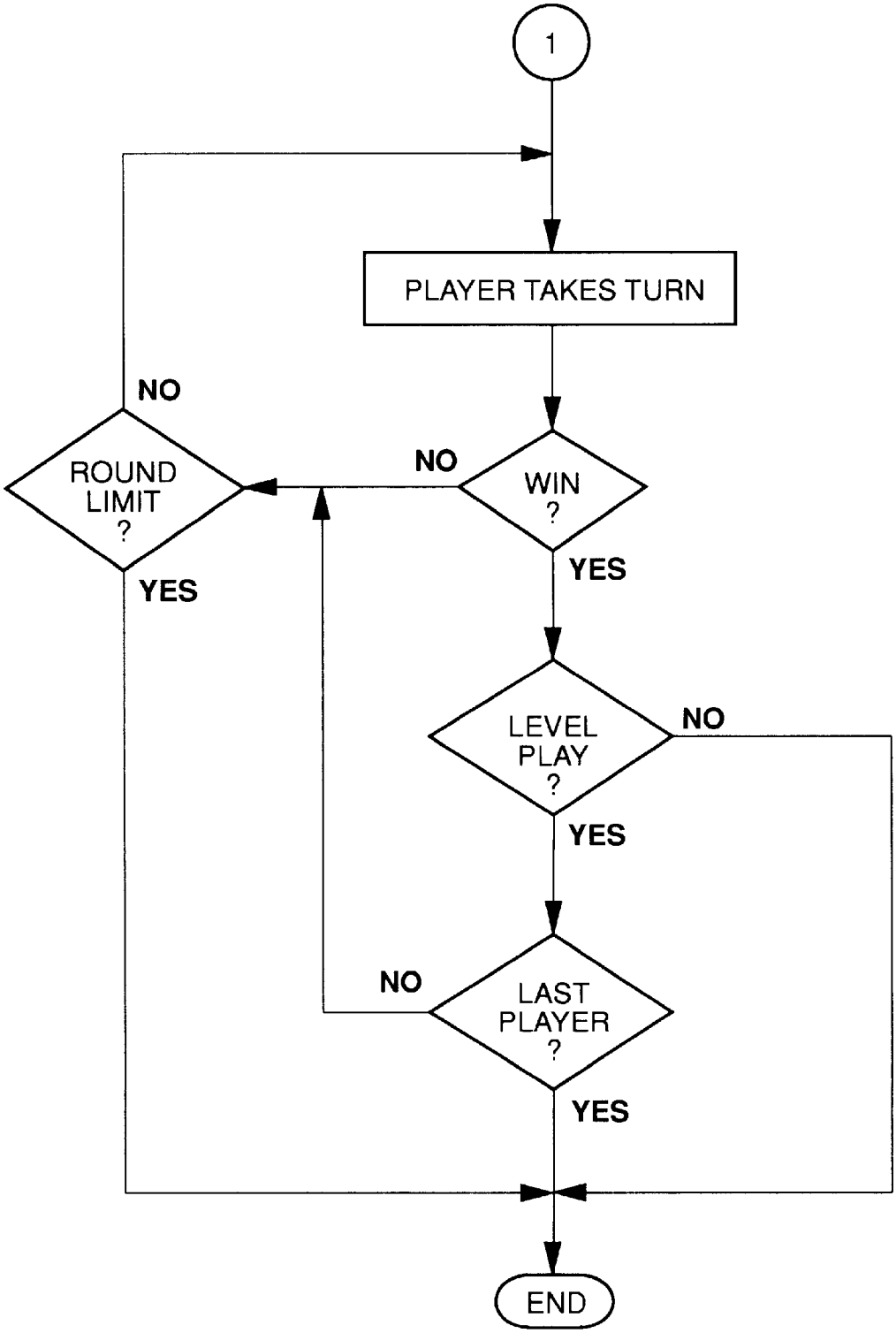

FIGS. 34 to 36 show a routine that can be incorporated into a cricket game program to control the cricket swing display so that versions of cricket that score segments other than 15–20 can be played.

It will thus be apparent that there has been provided in accordance with the present invention a league and tournament system which achieves the aims and advantages specified herein. It will of course be understood that the foregoing description is of a preferred exemplary embodiment of the invention and that the invention is not limited to the specific embodiment shown. For example, although the illustrated embodiment utilizes electronic dart machines, it will be appreciated many of the features of the illustrated embodiment can be utilized in connection with any type of electronically scored amusement game. Thus, various changes and modifications will become apparent to those skilled in the art and all such variations and modifications are intended to come within the spirit and scope of the appended claims.

What is claimed is:

1. An electronically scored dart machine for use as a part of a dart league system comprising:

a microprocessor;

an electronic target board coupled to said microprocessor;

an input device coupled to said microprocessor to provide said microprocessor with input data entered by a player;

a first area of memory coupled to said microprocessor for nonvolatile storage;

a main program stored in said first area of memory and including a plurality of game programs, at least one of said games programs having a plurality a game options associated therewith; and a second area of memory coupled to said microprocessor for storage of contest data that include a plurality of match data items which identify one or more planned games between different players and that further include game setup data associated with each of said match data items, wherein the game setup data identify one of said game programs and one or more of said game options, said microprocessor being operable under control of said main program and in response to the input data to access at least one of said match data items and retrieve the game setup data associated with the accessed match data items, said microprocessor further being operable under control of said main program to initiate execution of the one of said game programs associated with the accessed match data item using the one or more game options associated with the accessed match data item.

2. An electronically scored dart machine as defined in claim 1, wherein said input device is a card reader.

3. An electronically scored dart machine as defined in claim 1, wherein said input device includes a monitor having a user interface that includes user-selectable menu items.

4. An electronically scored dart machine for use as a part of a dart league system, the electronically scored dart machine comprising:

a microprocessor;

an electronic target board coupled to said microprocessor;

an input device coupled to said microprocessor to provide said microprocessor with input data entered by a player;

a first area of memory coupled to said microprocessor for nonvolatile storage;

a main program stored in said first area of memory and including a plurality of game programs, at least one of said game programs having a plurality of game options associated therewith; and a second area of memory coupled to said microprocessor for storage of contest data, said microprocessor being operable under control of said main program and in response to the input data to access a portion of the contest data that is associated with the input data, said portion of the contest data including game setup data that identified one of said game programs and one of said game options, said microprocessor further being operable under control of said main program to initiate execution of the identified one of said game programs and to select the identified one of said game options;

wherein said input device includes a monitor having a user interface that includes user-selectable menu items and wherein data from the contest data is incorporated into said user-selectable menu items.

5. An electronically scored dart machine as defined in claim 3, wherein said input device further includes at least one switch for selecting one of said menu items.

6. An electronically scored dart machine as defined in claim 1, wherein said game programs are routines included within said main program.

7. An electronically scored dart machine, comprising:

a microprocessor;

a first area of memory coupled to said microprocessor for nonvolatile storage;

a game program stored in said first area of memory;

a second area of memory coupled to said microprocessor for storage of players' scores;

an electronic target coupled to said microprocessor;

an input device coupled to said microprocessor; and a monitor coupled to said microprocessor, said microprocessor being operable under control of said game program to display a number scroller screen on said monitor and to permit player control of said number scroller screen using said input devices, said microprocessor being operable under control of said game program to permit a number of players to play a dart game organized into a first round and a plurality of subsequent rounds with the players' scores being inputted via said target and being accumulated in said second area of memory, said microprocessor being operable under control of said game program to utilize player handicaps to adjust the players' scores prior to the play of the first round.

8. An electronically scored dart machine, comprising:

a microprocessor;

a first area of memory coupled to said microprocessor for nonvolatile storage;

a game program stored in said first area of memory;

a second area of memory coupled to said microprocessor for storage of players' scores;

an electronic target coupled to said microprocessor;

said microprocessor being operable under control of said game program to permit a number of players to play a dart game, with the players' scores being inputted via said target and being accumulated in said second area of memory;

an infrared sensor oriented to detect human movement in front of said target;

an IR sensor circuit connected to said sensor and coupled to said microprocessor, said sensor circuit being operable in a first mode to detect human movement within a first distance of said target and in a second mode to detect human movement within a second distance of said target; and said microprocessor being operable under control of said game program to place said sensor circuit in said first mode during game play and to place said sensor circuit in said second mode during idle periods.

9. An electronically scored dart machine as defined in claim 8, wherein said sensor circuit comprises a digitally controlled potentiometer coupled to said microprocessor to change said sensor circuit between said first and second modes in response to an output of said microprocessor.

* * * * *